US008570190B2

(12) United States Patent
Marinakis et al.

(10) Patent No.: US 8,570,190 B2
(45) Date of Patent: Oct. 29, 2013

(54) CENTRALIZED ROUTE CALCULATION FOR A MULTI-HOP STREETLIGHT NETWORK

(75) Inventors: Dimitri Marinakis, Duncan (CA); Marcus Redivo, North Saanich (CA); Zoltan Varga, Victoria (CA); Jam Hamidi, Victoria (CA); Simon H. Lightbody, Victoria (CA)

(73) Assignee: LED Roadway Lighting Ltd., Halifax (CA)

( * ) Notice: Subject to any disclaimer, the term of this patent is extended or adjusted under 35 U.S.C. 154(b) by 611 days.

(21) Appl. No.: 12/231,929

(22) Filed: Sep. 8, 2008

(65) Prior Publication Data

US 2009/0066540 A1 Mar. 12, 2009

Related U.S. Application Data

(60) Provisional application No. 60/967,810, filed on Sep. 7, 2007.

(51) Int. Cl.
*G08G 1/07* (2006.01)
*F21L 4/00* (2006.01)

(52) U.S. Cl.
USPC ..... 340/915; 362/183

(58) Field of Classification Search
USPC ..... 701/19; 370/270, 328; 362/183; 340/2.1, 915, 902, 995.13, 539.1
See application file for complete search history.

(56) References Cited

U.S. PATENT DOCUMENTS 3,894,265 A 7/1975 Holmes et al.
3,989,976 A 11/1976 Tabor
4,082,981 A 4/1978 Morton et al.
4,350,930 A 9/1982 Peil et al.
4,516,056 A 5/1985 Cote
4,642,525 A 2/1987 Widmayer
4,647,763 A 3/1987 Blake
4,675,579 A 6/1987 Hardy et al.

(Continued)

FOREIGN PATENT DOCUMENTS

EP 0067011 A2 12/1982
EP 0447136 A2 9/1991

(Continued)

OTHER PUBLICATIONS

Maicas, Jesús; Communication pursuant to Article 94(3) EPC; Application No. 06 752 830.7-2206; Nov. 2, 2011; European Patent Office; Germany; D2 Reference listed in Communication is GB 2345998 which published Jul. 26, 2000.

(Continued)

*Primary Examiner* — Benjamin C Lee
*Assistant Examiner* — Sigmund Tang
(74) *Attorney, Agent, or Firm* — Stevens & Showalter LLP

(57) ABSTRACT

A system and various apparatus and methods performed therein configured for calculating routes touching and monitoring and controlling streetlights includes a multiplicity of streetlight controllers and a local coordinator. Each streetlight controller includes a switch operative to control the operation of a load, a sensor operative to monitor the operation of the load, a processor, and a radio transceiver operative to receive control data and transmit data associated with the streetlight controller. The local coordinator includes a coordinator radio transceiver, and a coordinator processor operative to maintain a list of the multiplicity of streetlight controllers and, cooperatively with the coordinator radio transceiver, exchange messages with any of the multiplicity of streetlight controllers.

20 Claims, 21 Drawing Sheets

(56) References Cited

U.S. PATENT DOCUMENTS

| | | | | |
|---|---|---|---|---|
| 4,777,607 | A | 10/1988 | Maury et al. | |
| 4,931,701 | A | 6/1990 | Carl | |
| 4,933,607 | A | 6/1990 | Vogel | |
| 4,980,806 | A | 12/1990 | Taylor et al. | |
| 4,994,718 | A | 2/1991 | Gordin | |
| 5,004,957 | A | 4/1991 | Cunningham | |
| 5,216,333 | A | 6/1993 | Nuckolls et al. | |
| 5,235,252 | A | 8/1993 | Blake | |
| 5,266,807 | A | 11/1993 | Neiger | |
| 5,327,048 | A | 7/1994 | Troy | |
| 5,336,976 | A | 8/1994 | Webb et al. | |
| 5,406,176 | A | 4/1995 | Sugden | |
| 5,451,843 | A | 9/1995 | Kahn et al. | |
| 5,495,329 | A | 2/1996 | Anderson, II et al. | |
| 5,701,058 | A | 12/1997 | Roth | |
| 5,751,116 | A | 5/1998 | Thomas et al. | |
| 5,902,994 | A | 5/1999 | Lisson et al. | |
| 5,962,988 | A | 10/1999 | Nuckolls et al. | |
| 5,962,991 | A | 10/1999 | Levy | |
| 6,031,340 | A | 2/2000 | Brosius | |
| 6,035,266 | A | 3/2000 | Williams et al. | |
| 6,057,674 | A | 5/2000 | Bangerter | |
| 6,114,816 | A | 9/2000 | Nuckolls et al. | |
| 6,119,076 | A | 9/2000 | Williams et al. | |
| 6,191,568 | B1 | 2/2001 | Poletti | |
| 6,204,615 | B1 | 3/2001 | Levy | |
| 6,316,923 | B1 | 11/2001 | Poletti | |
| 6,337,001 | B1 | 1/2002 | Haag et al. | |
| 6,359,555 | B1 | 3/2002 | Williams | |
| 6,370,489 | B1 | 4/2002 | Williams et al. | |
| 6,393,381 | B1 | 5/2002 | Williams et al. | |
| 6,393,382 | B1 | 5/2002 | Williams et al. | |
| 6,393,608 | B1 | 5/2002 | Pulford | |
| 6,415,245 | B2 | 7/2002 | Williams et al. | |
| 6,441,565 | B1 | 8/2002 | Levy | |
| 6,452,339 | B1 | 9/2002 | Morrissey et al. | |
| 6,456,373 | B1 | 9/2002 | Wienecke et al. | |
| 6,456,960 | B1 | 9/2002 | Williams et al. | |
| 6,548,967 | B1 | 4/2003 | Dowling et al. | |
| 6,577,075 | B2 | 6/2003 | Romano et al. | |
| 6,604,062 | B2 | 8/2003 | Williams et al. | |
| 6,631,063 | B2 | 10/2003 | Ortiz et al. | |
| 6,677,814 | B2 | 1/2004 | Low et al. | |
| 6,704,301 | B2 | 3/2004 | Chari et al. | |
| 6,714,895 | B2 | 3/2004 | Williams et al. | |
| 6,791,284 | B1 | 9/2004 | Levy | |
| 6,807,516 | B2 | 10/2004 | Williams et al. | |
| 6,841,944 | B2 | 1/2005 | Morrissey et al. | |
| 6,856,101 | B1 | 2/2005 | Hitchcock | |
| 6,889,174 | B2 | 5/2005 | Williams et al. | |
| 6,892,168 | B2 | 5/2005 | Williams et al. | |
| 6,965,575 | B2 | 11/2005 | Srikrishna et al. | |
| 7,034,466 | B2 | 4/2006 | Tsao | |
| 7,035,932 | B1 * | 4/2006 | Dowling | 709/230 |
| 7,045,968 | B1 | 5/2006 | Bierman et al. | |
| 7,050,808 | B2 | 5/2006 | Janusz et al. | |
| 7,098,805 | B2 * | 8/2006 | Meadows et al. | 340/905 |
| 7,168,822 | B2 | 1/2007 | Abramovich et al. | |
| 7,355,726 | B2 | 4/2008 | Jeffers et al. | |
| 7,653,010 | B2 * | 1/2010 | Ensor et al. | 370/255 |
| 8,026,698 | B2 * | 9/2011 | Scheucher | 320/136 |
| 8,029,154 | B2 * | 10/2011 | Myer | 362/145 |
| 8,248,948 | B2 * | 8/2012 | Weil et al. | 370/237 |
| 8,456,325 | B1 * | 6/2013 | Sikora | 340/909 |
| 2002/0062180 | A1 | 5/2002 | Enberg | |
| 2002/0152045 | A1 | 10/2002 | Dowling et al. | |
| 2003/0035460 | A1 | 2/2003 | Tsikos et al. | |
| 2003/0098353 | A1 | 5/2003 | Tsikos et al. | |
| 2003/0132720 | A1 | 7/2003 | El Bitar | |
| 2004/0105264 | A1 | 6/2004 | Spero | |
| 2004/0130909 | A1 | 7/2004 | Mueller et al. | |
| 2004/0264422 | A1 * | 12/2004 | Calcev et al. | 370/338 |
| 2005/0035720 | A1 | 2/2005 | Blake | |
| 2005/0054292 | A1 | 3/2005 | Janusz et al. | |
| 2005/0253538 | A1 | 11/2005 | Shah et al. | |
| 2006/0056331 | A1 | 3/2006 | Ratiu et al. | |
| 2006/0056363 | A1 | 3/2006 | Ratiu et al. | |
| 2007/0043540 | A1 | 2/2007 | Cleland et al. | |
| 2007/0201540 | A1 * | 8/2007 | Berkman | 375/219 |
| 2007/0222581 | A1 * | 9/2007 | Hawkins et al. | 340/539.1 |
| 2007/0282547 | A1 | 12/2007 | Howell et al. | |
| 2009/0066258 | A1 | 3/2009 | Cleland et al. | |
| 2009/0072944 | A1 * | 3/2009 | Hayward | 340/2.1 |
| 2011/0057570 | A1 | 3/2011 | Cleland et al. | |
| 2011/0085322 | A1 * | 4/2011 | Myer | 362/183 |
| 2012/0262093 | A1 * | 10/2012 | Recker et al. | 315/308 |

FOREIGN PATENT DOCUMENTS

| | | | |
|---|---|---|---|
| EP | 0573323 | A2 | 12/1993 |
| EP | 0669787 | A1 | 8/1995 |
| GB | 2213983 | A | 8/1989 |
| GB | 2224589 | A | 5/1990 |
| GB | 2291993 | A | 2/1996 |
| GB | 2345998 | A | 7/2000 |
| JP | 2003059678 | | 2/2003 |
| WO | 8905536 | | 6/1989 |
| WO | 9216086 | | 9/1992 |
| WO | 9310591 | A1 | 5/1993 |
| WO | 9802859 | A1 | 1/1998 |

OTHER PUBLICATIONS

Le, John; Final Office Action in U.S. Appl. No. 11/899,841; Feb. 9, 2012; U.S. Patent and Trademark Office; Alexandria, VA.

Public Works; Lighting street lighting; The 1996 Public Works Manual; Streets and Highways; Apr. 15, 1996; Dailog; pp. 1-7.

Rapp, Chad; Non-final Office Action in U.S. Appl. No. 11/479,222; Jul. 9, 2008; U.S. Patent and Trademark Office; Alexandria, VA.

Rapp, Chad; Non-final Office Action in U.S. Appl. No. 11/479,222; Feb. 20, 2009; U.S. Patent and Trademark Office; Alexandria, VA.

Rapp, Chad; Non-final Office Action in U.S. Appl. No. 11/479,222; Dec. 11, 2009; U.S. Patent and Trademark Office; Alexandria, VA.

Rapp, Chad; Non-final Office Action in U.S. Appl. No. 11/479,222; Jul. 6, 2010; U.S. Patent and Trademark Office; Alexandria, VA.

Rapp, Chad; Non-final Office Action in U.S. Appl. No. 11/479,222; Dec. 20, 2010; U.S. Patent and Trademark Office; Alexandria, VA.

Rapp, Chad; Notice of Allowance in U.S. Appl. No. 11/479,222; Nov. 23, 2011; U.S. Patent and Trademark Office; Alexandria, VA.

Vu, David; Non-final Office Action in U.S. Appl. No. 12/946,768; Jun. 9, 2011; U.S. Patent and Trademark Office; Alexandria, VA.

Vu, David; Notice of Allowance in U.S. Appl. No. 12/946,768; Jan. 3, 2012; U.S. Patent and Trademark Office; Alexandria, VA.

Chad Rapp; Notice of Allowance and Fees Due; U.S. Appl. No. 11/479,222; Dec. 5, 2012; United States Patent and Trademark Office; Alexandria, VA.

* cited by examiner

True Broadcast Mode:

CENTRALIZED ROUTE CALCULATION FOR A MULTI-HOP STREETLIGHT NETWORK

RELATED APPLICATIONS

This application claims the benefit of U.S. provisional application Ser. No. 60/967,810 entitled "Centralized Route Calculation for a Multi-Hop Network" filed Sep. 7, 2007 which is hereby incorporated by reference. This application relates to communications techniques for Streetlight Monitoring and Control Systems, such as the one described in U.S. patent application Ser. No. 11/899,841 entitled "Streetlight Monitoring and Control" and filed on Sep. 7, 2007, which is hereby incorporated by reference.

FIELD OF THE INVENTION

This invention relates in general to streetlight monitoring and control systems and more specifically such techniques, apparatus, and systems using multi-hop networks.

BACKGROUND OF THE INVENTION

Wireless streetlight control systems generally involve the control of hundreds or more streetlights distributed over a wide geographic area. Ad hoc deployable wireless networks are an emerging technology with applications in a variety of information gathering and control fields. Communications may be multi-hop and of mesh topology due to the restricted range and reliability of radio frequency transmissions that don't consume a significant amount of electrical power and are of reasonable cost.

BRIEF DESCRIPTION OF THE DRAWINGS

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
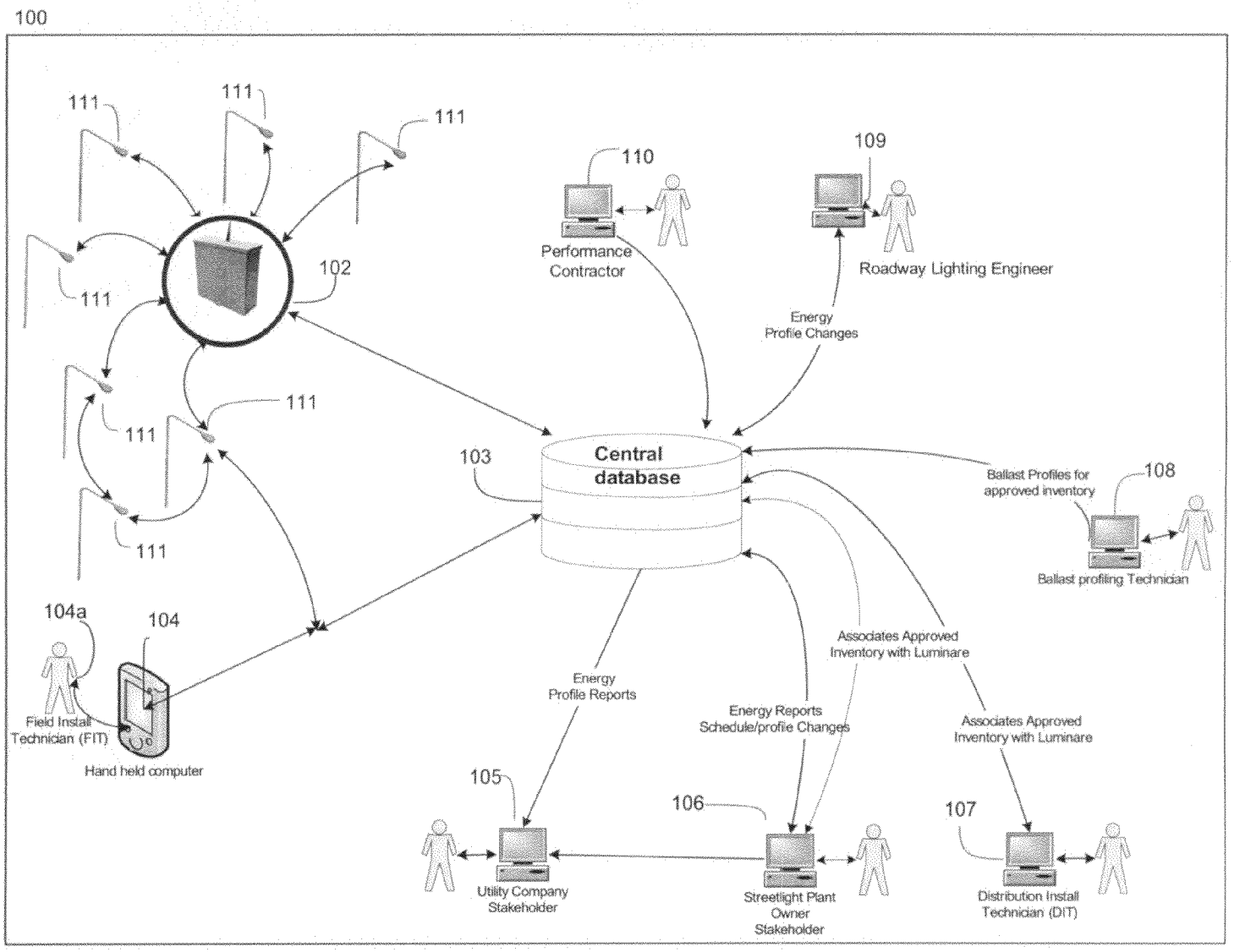
FIG. 1 simplified and representative high level diagram of a street light monitoring and control system in accordance with one or more embodiments.

In overview, the present disclosure concerns lighting monitoring and controlling systems, e.g., streetlight systems, and more specifically techniques and apparatus for providing appropriate information and using such information for controlling, maintaining, managing a system and streetlights within the system as well as other attributes that will become evident from the following discussions.

The lighting systems of particular interest may vary widely but include by way of example, outdoor systems for streets, parking, and general area lighting, indoor systems for general area lighting (malls, arenas, parking, etc.), and underground systems for roadways, parking, etc. One aspect that can be particularly helpful using the principles and concepts discussed and disclosed below is improved metering (for power consumption) and controlling light levels for lighting fixtures, e.g., streetlights, luminaires, or simply lights, provided the appropriate methods and apparatus are practiced in accordance with the inventive concepts and principles as taught herein.

The instant disclosure is provided to further explain in an enabling fashion the best modes, at the time of the application, of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in integrated circuits (ICs) including possibly application specific ICs or ICs with integrated processing controlled by embedded software or firmware. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts according to the present invention, further discussion of such software and ICs, if any, will be limited to the essentials with respect to the principles and concepts of the various embodiments.

The following description provides many examples in accordance with the present invention including a streetlight monitoring and control systems with associated apparatus and methods, organization thereof, etc. The system may be used to reduce or increase the power to the streetlight adaptively based on numerous parameters such as pedestrian conflict level, dawn and dusk times, environmental conditions, lighting and power demands, etc. The system uses this methodology to provide, e.g., more efficient communication and it also aids in tracking the performance of a streetlight plant (lighting system).

Referring to FIG. 1, a simplified and representative high level diagram of a street light monitoring and control system in accordance with one or more embodiments will be briefly discussed and described. FIG. 1 shows an overview of the system which allows the control of individual streetlights or a network of streetlights from a central location or multiple locations. The streetlight system 100 comprises a plurality of streetlights 111. Each streetlight 111 comprises a streetlight controller (see 201, FIG. 2), which enables, facilitates, or otherwise supports monitoring and control of the streetlight as well as communications, wired or wireless, between the streetlights and other entities, e.g., local gateway 102, etc., in the system.

Local gateway 102 (alternatively referred to as local coordinator) communicates through an appropriate communications media (such as cell modem, wired internet, etc.) to a central controller and database 103 (alternatively referred to as a central database or central or central coordinator). It will be appreciated that the central controller and database 103 can be comprised of one or more servers and databases in one or more locations that collectively operate as a repository of data and a central control/coordination point for the overall system.

Generally before the streetlights 111 are installed, the constituent elements or components, e.g., ballast, lamp, and capacitor combinations, can be profiled or characterized using a component profiling station 108. The data or information collected via the component profiling station 108 is sent to the central database 103. The streetlights 111 are prepared and entered into inventory with the appropriate ballast/capacitor/lamp/etc. (component) combination by the distribution install technician 107 before they are installed. This ensures that the system knows the characteristics of a particular ballast, lamp, luminaire combination for a given configuration of streetlight 111. As the streetlights or luminaires are installed in the field by the field install technician 104*a*, data (data-logs and other information) for each is collected using, e.g., a hand held computing device 104 to communicate directly or through the local gateway 102 to each streetlight (via associated streetlight controller 201) and possibly the central database 103. Among other uses, the central database allows a roadway lighting engineer 109 to make schedule changes to the streetlights (ON, OFF, Levels, times, etc.). Maintenance reports may be sent to the performance contractor 110 by the central database 103. Information can be gathered and included in energy reports (metering or power consumption), which can be sent to the utility company 105 and the streetlight plant owner 106 from the central database 103.

Figure 2:
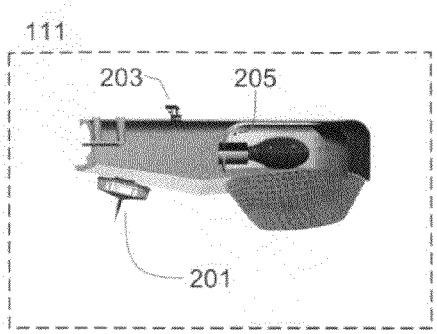
FIG. 2 in a representative form, shows a diagram of a portion of a street light suitable for use in the system of FIG. 1 in accordance with one or more embodiments.

Referring to FIG. 2 a diagram of a portion of a street light suitable for use in the system of FIG. 1 will be briefly discussed and described. FIG. 2 shows an embodiment of the streetlight controller 201 mounted to a surface of the street light (alternatively streetlight fixture or luminaire). Further depicted is a day night sensor 203 that is mounted to an external surface of the streetlight and a lamp sensor 205 that is mounted to an internal surface (typically a reflector) that is adjacent to the lamp. In some of the discussions below, the streetlight controller may be referred to as a node 400 (in a mesh communication system).

Each streetlight controller 201 communicates via a wireless radio (or other data communications means) to the local gateway 102. Streetlight controllers 201 may also communicate via other streetlight controllers 201 especially if the first controller 201 is out of range of the local gateway 102.

Typically, before the controllers 201 are installed in the streetlights 111, ballast, lamp and capacitor combinations are profiled and data indicative of the profiling is provided to the central database 103. As the controller 201 is installed in each streetlight 111 and the streetlight installed, e.g., by the field-install technician 104*a*, the hand held computing device 104 can be used to communicate with the controllers 201 directly or through the local gateway 102 and also with the central database 103 for requisite configuration and set up information. The controller 201 communicates to the local gateway 102 and sends its data-logs and other information. The local gateway 102 sends this data to the central database 103.

Figure 3:
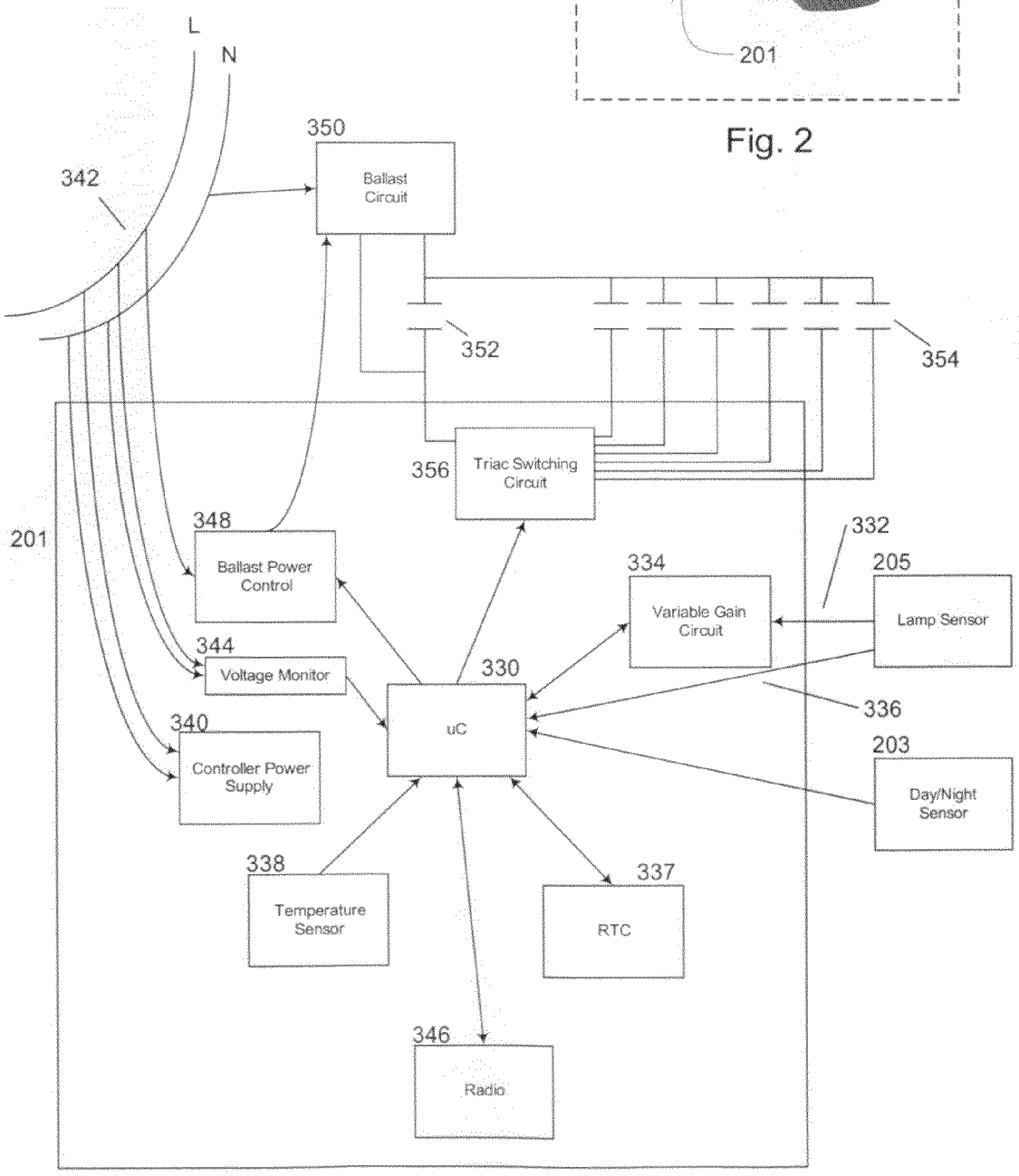
FIG. 3 depicts a representative block diagram of a controller for a streetlight in accordance with one or more embodiments.

Referring to FIG. 3, a representative block diagram of a controller 201 for a streetlight in accordance with one or more embodiments will be discussed and described. FIG. 3 depicts the streetlight controller 201 in block diagram form as it is interfaced to the system. A microprocessor or microcontroller 330 with appropriate firmware and memory controls the operation of the streetlight controller 201, stores configuration data and maintains data-logs, and processes incoming and initiates outgoing communications and messages to/from the local gateway 102, other streetlight controllers, etc. The lamp sensor 205 provides a first signal 332 that is indicative of the light intensity from the lamp within the streetlight 111. This first signal 332 is amplified by a variable gain circuit 334 before being applied to an analog to digital input of the microcontroller 330. Adjustment of the gain of the variable gain circuit 334 is controlled by the microcontroller 330. The lamp sensor also provides a second signal 336 indicative of the temperature of the lamp sensor to the microcontroller 330. This signal can be used by the microcontroller 330 to compensate for temperature and line voltage effects on the output of the lamp sensor (first signal 332). The day night sensor 203 monitors the external light level and thus whether it is day or night.

A real time clock circuit 337 interfaces to the microcontroller to provide time and day information to the microcontroller 330. A temperature sensor 338 provides local system temperature to the microcontroller 330. This temperature is often substantially less than the temperature of the lamp sensor 205 due to the proximity of the lamp sensor to the lamp. Controller power supply 340 interfaces to the power line 342 and provides regulated power for operation of the streetlight controller 201. A voltage monitoring circuit 344 which can comprise an appropriate resistive divider, differential amplifier, op-amp circuit, combination thereof, etc. provides the microcontroller 330 with a signal indicative of the line voltage of the power line 342.

RF wireless radio 346 which can comprise a model AC4490-100 from Aerocomm Inc. located in Lenexa, Kans. provides wireless communication between the microcontroller 330 in streetlight controller 201, other streetlight controllers 201 in other streetlights 111, the handheld computing device 104, or the local gateway 102. Similar or identical RF wireless radios (not shown) may be present in these devices to receive and transmit data. The RF wireless radio in one streetlight 111 in addition to receiving and transmitting messages for its controller may relay the data to/from another RF wireless radio 346 in another streetlight 111. Thus, the streetlights and other components containing wireless radios may comprise a mesh network.

Ballast power control circuitry 348 interfaces to microcontroller 330 and responsive to the microcontroller, functions to turn a ballast circuit 350 on and off. The ballast circuit 350 regulates power applied to the lamp (not specifically shown) within the streetlight 111. The ballast circuit may interface to a base capacitance 352 and a plurality of switched capacitors 354. In addition, the microcontroller 330 interfaces through triac switching circuitry 356 to control the amount of power that is delivered to the lamp via the ballast circuit 350. The triac switching circuit together with the switching capacitors and ballast is one embodiment of a switching network which can be used to adjust or set light levels of a lamp in a streetlight. Basically, the microcontroller 330 controls the triac switching circuitry 356 to select particular ones of the switched capacitors 354 that are coupled in parallel with the base capacitance 352 and thus the total capacitance that is coupled to the ballast circuit 350. In this manner the amount of power that is delivered to the lamp is controlled or adjustable and thus the light level of the lamp can be adjusted and a particular light output or light level can be obtained. As suggested by FIG. 3, the capacitors and ballast circuit are typically not a specific part of streetlight controller 201 (although a portion may be) and typically will be contained within the body of the streetlight or luminaire.

FIG. 3 is thus illustrative of a controller 201 for a streetlight that includes a microcontroller or microprocessor, a first sensor coupled with or to the microcontroller and operative to sense a light level from a lamp within the streetlight, and a second sensor coupled with or to the microcontroller and operative to sense a voltage level of a power supply, e.g., on a power line supplying power to the streetlight or relevant portions thereof. The controller further includes a switching network that is coupled with or to the microcontroller and is operative to adjust the light level of the lamp, i.e., set the light level to a desired level based on outputs from the first and second sensors by selectively adjusting the switching network. The microcontroller is operative to facilitate an estimate of energy usage or power consumption for the streetlight (determined or calculated by the microcontroller or by another entity, e.g., the central server or database from information supplied by the microcontroller) based on the light level and the voltage level in accordance with one or more concepts further noted below. The switching network includes one or more of a plurality of switching capacitors that may be selectively used, e.g., via a triac switching circuit controllable by the microcontroller, to adjust the light level.

Figure 4:
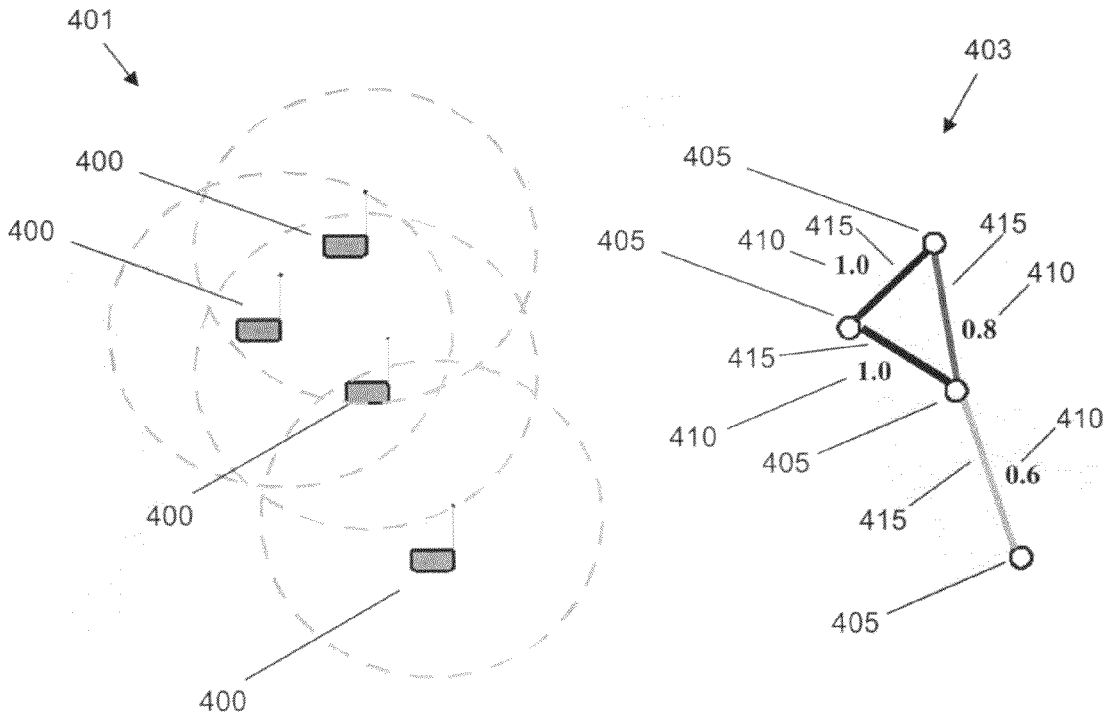
FIG. 4 depicts a conceptual high level model of a network as a graph with vertexes and connectivity weights between the vertexes in accordance with one or more embodiments.

Referring to FIG. 4, a conceptual high level model of a network 401 is shown as a graph 403 with vertexes 405 and connectivity weights 410 for connections or links 415 between the vertexes in accordance with one or more embodiments. The conceptual graph 403 is a model of the network or subnet 401 in which each vertex 405 represents a base level network device (such as node 400—see FIG. 5), and each edge weight 410 represents potential connectivity. The edge weight 410 corresponds to the link quality of the corresponding inter-node communication link; e.g. estimated transmission probability between the two nodes or some other suitable metric. The edge weight may be referred to herein as link strength, link cost, link probability, link quality information or similar terms. Those of ordinary skill will appreciate that these concepts alt relate to the desirability of using the link for communication between respective vertexes or nodes or transmission probability. Normally strengths, probability, and quality indicia increase with desirability and costs decrease. As will be further discussed, recovery of or determining a representation of this graph, which is sufficiently accurate (specifically the existence and weights of the edges) will facilitate determining appropriate routing paths within the network. FIG. 4 can be a representative portion of the system of FIG. 5.

Figure 5:
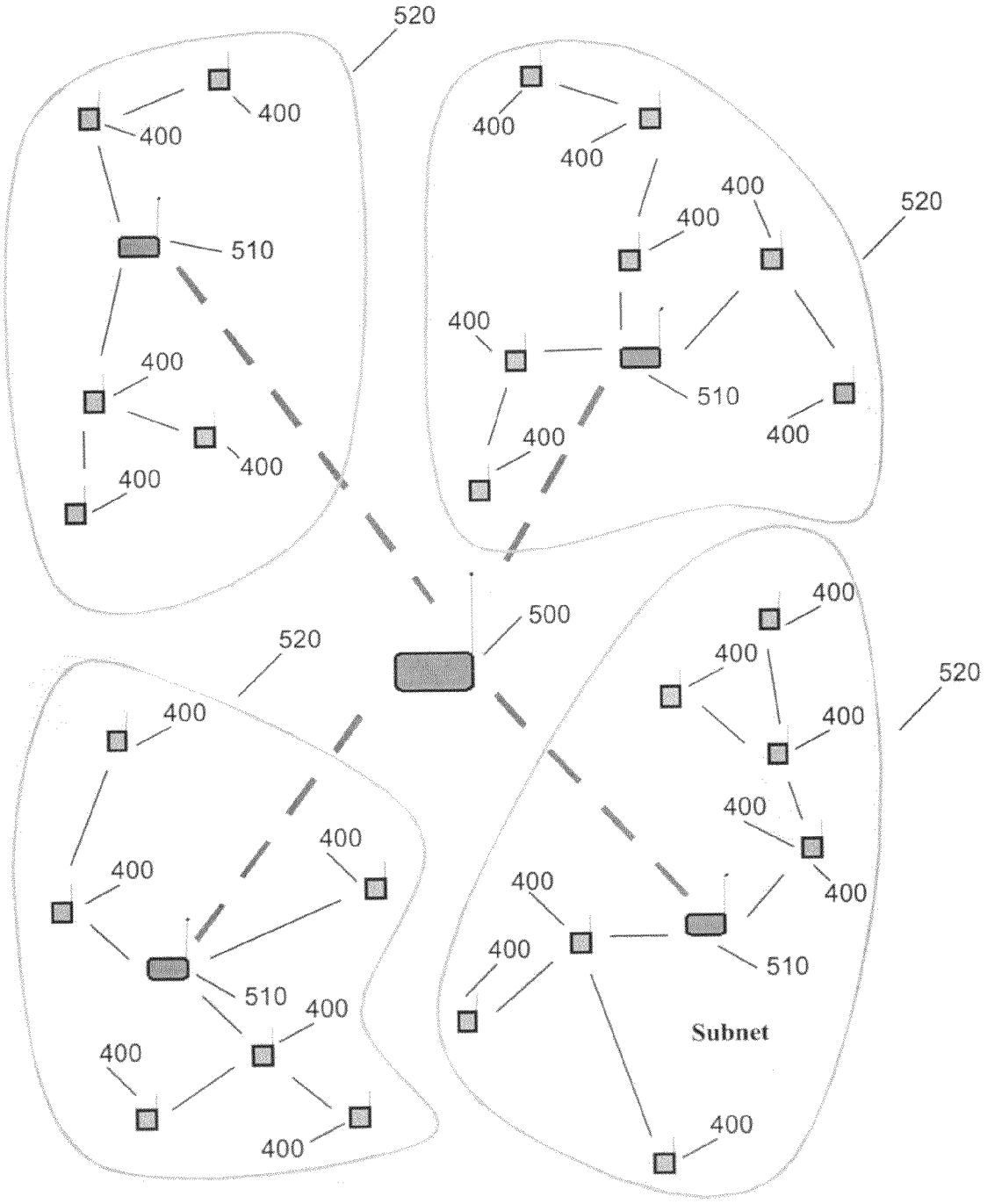
FIG. 5 depicts a representative diagram of a system with subnets organized in accordance with one or more embodiments.

Referring to FIG. 5, a representative diagram of a system with subnets 520 organized in accordance with one or more embodiments will be briefly discussed and described. The FIG. 5 system and constituent elements will be referred to subsequently in this description. FIG. 5 depicts a multiplicity of nodes 400 and links between these nodes (lines). The streetlight 111 or streetlight controller 201 is one example of the node 400 (or end device). A local coordinator 510 (one per subnet as shown) will be referred to and is responsible for coordination of the subnet communications and in some embodiments developing the links for the subnet. The local gateway 102 is one example of the local coordinator 510. A central coordinator 500 will be referred to. The central database 103 is one example of a central coordinator 500.

The general requirements for communication in a data collection or control network can be somewhat different than those of a more general purpose multi-hop network such as the internet. For example, in a control system, there is generally no requirement for peer to peer communications between network components, and it is adequate that all communications are initiated from a central location. It is also typical that a node in a typical network of this type may be resource-limited and may have little RAM and processing power allocated to it for communication duties. For data collection systems the requirements are similar, although there may be a need that communications are initiated from a node. However, in many monitoring situations, this requirement can be addressed by a polling scheme, wherein a central entity initiates all communications and simply requests that appropriate information be forwarded.

One of the challenges faced with these large scale networks is the automatic management of communications. This can include finding and maintaining the routing paths necessary to maintain the required communication to each participating network device (nodes, etc.). In a practical deployment scenario, this can include: i.) the initial discovery of each network component and gathering of connectivity information; and ii.) the construction and assessment of various, possibly, multi-hop routes.

This second task may be referred to as route maintenance and this needs to be addressed continuously or from time to time throughout the life time of the network, since nodes can fail or connectivity can alter or vary as seasons or other environmental variables change, components age or nodes are added and the like. Additionally, radio frequency transmissions are plagued with interference and connectivity between static points can alter significantly depending on levels of activity in the environment, environmental and seasonal variations, etc. Therefore the system should be capable of quickly or timely adjusting for variations in connectivity.

The following discussions will describe one or more embodiments of methods and systems for facilitating, maintaining, or controlling a multi-hop wireless network of devices. This is done in one or more embodiments via the generation of routing paths suitable for use with a source routed protocol. Specifically, the problem of providing centrally coordinated connectivity initially, and on an ongoing basis, to an ad hoc deployed network of devices is addressed, where 1.) each of the network components has a limited communication range and could require multi-hop communications and where 2.) the inter-device connectivity data for each of these deployed devices is initially unknown and where 3.) it is impossible or undesirable to place significant computational sophistication at the level of a typical network component (node, etc.).

After the initial deployment of the individual network components (including the nodes 400, local coordinators 510 and central coordinator 500), in some embodiments it is the responsibility of each local coordinator 510 to establish, from time to time, communications with as many of the deployed nodes 400 as possible. A subnet 520, comprised of one local coordinator 510 and one or more nodes 400, does not require a specific hardware platform for either the nodes 400 or for the local coordinator 510, and furthermore the hardware platform need not be homogenous throughout the network.

Figure 6:
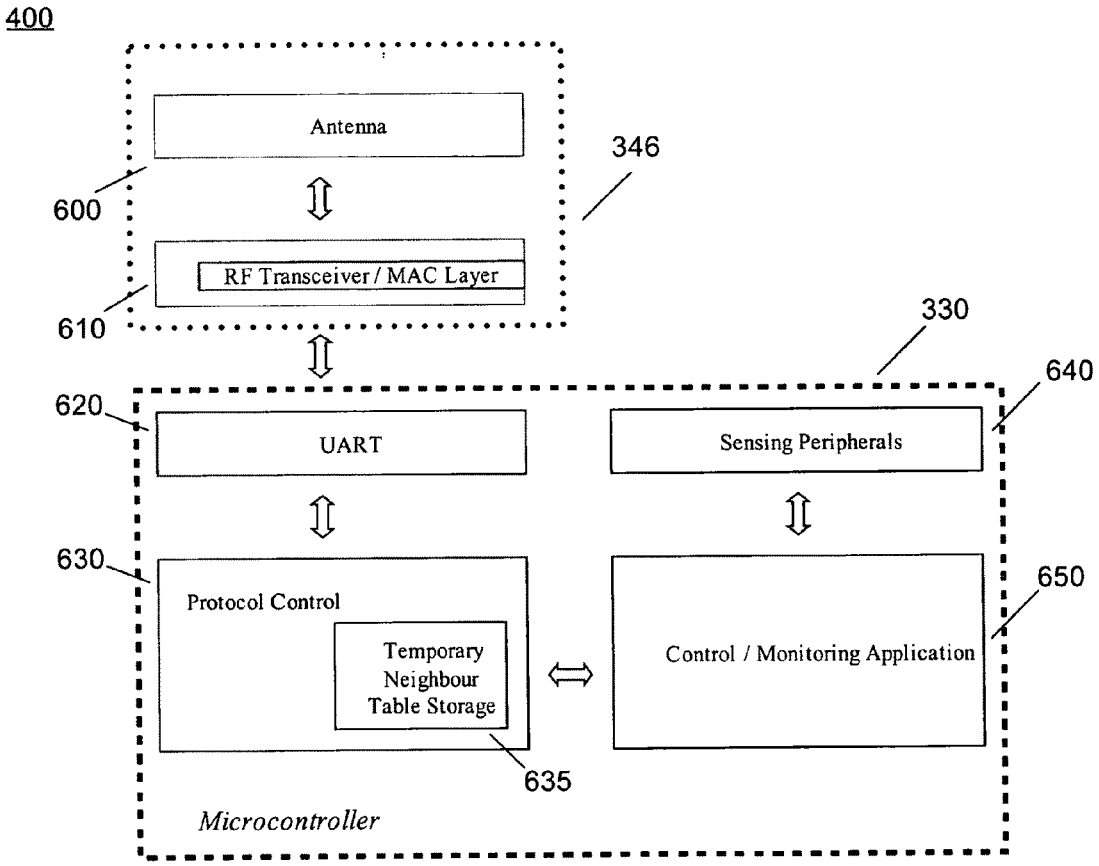
FIG. 6 illustrates a representative block diagram for an end node or device in accordance with one or more embodiments.
Figure 7:
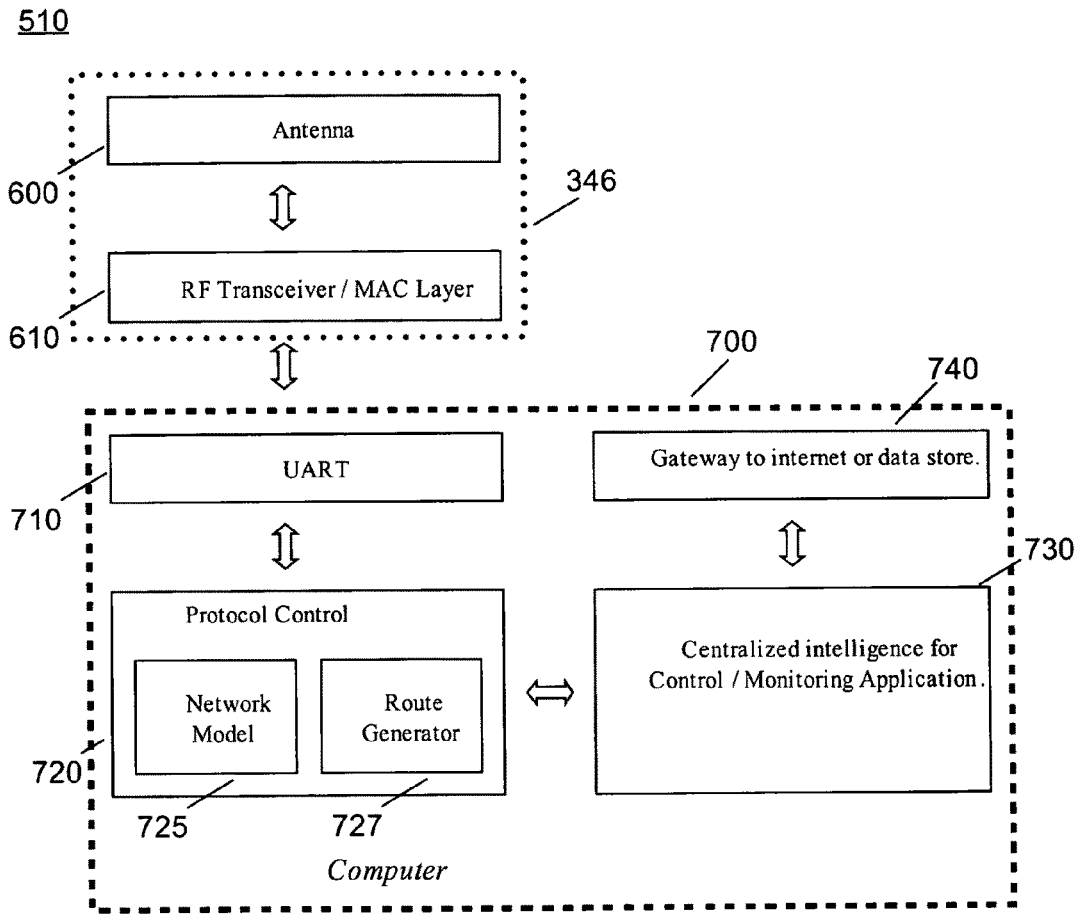
FIG. 7 illustrates a representative block diagram for a local coordinator or node in accordance with one or more embodiments.

Referring to FIG. 6 and FIG. 7, representative block diagrams for, respectively, an end node or device 400 and a local coordinator 510 in accordance with one or more embodiments will be discussed and described.

The RF wireless radio 346 comprises an antenna 600 and RF transceiver including a MAC layer 610 for facilitating wireless communication with another device. The microcontroller 330 interfaces to the RF wireless radio 346 through UART 620. Protocol control logic 630 within the microcontroller 330 implements protocol operation and interfaces with Universal Asynchronous Receiver/Transmitter (UART) 620 for data transmission/reception. The protocol control logic 630 includes storage for a list of addresses of neighbors or neighbor table 635. This table may only be stored temporarily (until requested by and forwarded to the local coordinator) and the table may also include an indicia of quality of a link to the, respective, neighbor. Other functionality of the node 400 is implemented in control/monitoring logic 650 interfaced with the protocol control logic 630 and peripherals 640.

The local coordinator 510 also comprises its own RF wireless radio 346 which may or may not be the same design as the RF wireless radio 346 within node 400. Computing logic 700 interfaces to the RF wireless radio 346 through UART 710. Protocol control logic 720, including network model logic 725 and route generator logic 727, provide network control and operation. Additional logic 730 for the control/monitoring scheme being implemented may be provided. The computing logic 700 also comprises a gateway 740 to provide data transfer to the internet and/or a data store, e.g., the central coordinator 500. It will be appreciated that a node 400 and local coordinator 510 could be equivalent devices if the appropriate and respective functionality were included in each. In practice it may be economically impractical to include the processing and memory and functionality of a local coordinator in each node.

In one or more embodiments, a process for establishing communication among the nodes 400 and the local coordinator 510 comprises a node discovery process in which the local coordinator 510 builds a representation of the network connectivity graph, and a process of generating and maintaining a set of routes, where, if possible, at least one route reaches each node 400.

Figure 8:
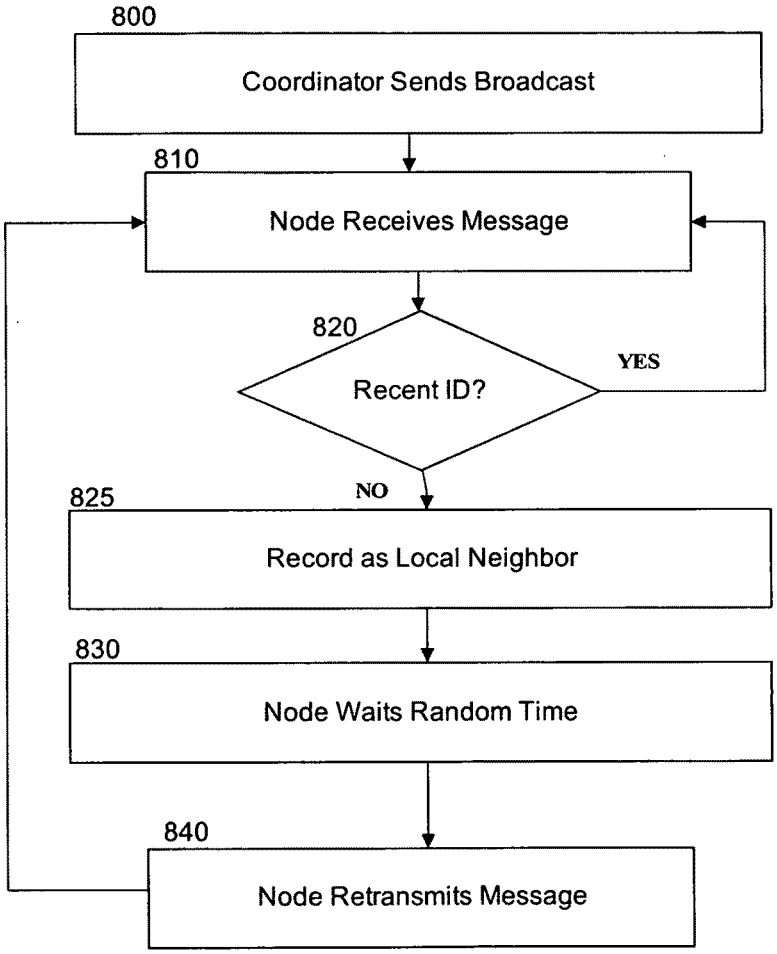
FIG. 8 shows a flow chart of representative methods of node discovery that may be used in organizing a network, e.g., as in the FIG. 5 system, in accordance with one or more embodiments.

Referring to FIG. 8, a flow chart of representative methods of node discovery that may be used in organizing a network, e.g., as in the FIG. 5 system in accordance with one or more embodiments will be discussed and described. The methods of FIG. 8 in one or more embodiments can be scheduled (via a programmed schedule in a local coordinator or as directed from a central coordinator or as otherwise determined). A first step taken, e.g., by the local coordinator 510, is to initiate a node discovery process. The mechanism for this discovery process is a broadcast discovery message that is first transmitted by the local coordinator 510 (block 800). This message has a unique message ID and includes an address associated with the sending transmitter. The message indicates to those who receive it that the transmitter, i.e., associated address, should be recorded in a local list (maintained on each device) as a neighbor or neighbor list (block 825). Each network member (node, etc.) who receives this message (block 810) will wait a random amount of time (block 830) and re-broadcast (block 840) it, with their address, one or more times based on message ID filtering (block 820). I.e., each network member will not transmit a received message having the same message ID as some number of the last broadcast messages received, and/or of messages received within some time period. At the end of the process (after all members who can be reached have re-broadcast the broadcast discovery message), each member or node 'connected' to the coordinator by a connectivity link (comprising one or more hops) should have a locally maintained list of neighbors. Each node can also include an associated indicia of quality of the link to its, respective, neighbors, if desired.

Subsequent to initiating the discovery process, the local coordinator 510 communicates with each of the discovered nodes using the process described below and recovers from each reachable device its set of neighbors (neighbor list or list of addresses and quality indicia if available). This neighbor table information is assembled together into a model of the network connectivity. In an alternate embodiment, the node discovery process could be repeated a number of times and the results averaged to build up a network model based on probabilistic estimates of inter-node 400 link strength. A standard shortest path algorithm such as Dijkstra's, Floyd-Warshall's, or the like is then used to find a near-optimal route to each reachable node 400 given this empirically obtained model of connectivity. This primary, shortest path route for each, respective, node is cached and is used for routine communications with each node. It will be appreciated that "shortest" as used here refers to near minimum costs or near maximum probability, rather than necessarily a physical quantity. Nodes 400 for which it is not possible to generate an acceptable route are identified as orphans and can be listed, for review by a network technician. This orphan listing can be provided by the local coordinator, assuming it knows the nodes it is expected to be able to reach, or be assembled by a technician given the reachable nodes, etc.

If the cached shortest path route fails during normal operation, then an alternate route can be easily found since the local coordinator 510 maintains a model of connectivity within the network. An example of a method of generating a backup route is described in a later section. This process may be initiated dynamically when a route fails (after some number of retries), or a backup route may be prepared offline along with the primary route. In addition to initial deployment, the discovery process may be run periodically, e.g., during lulls in communication, and so provide an up to date model of network connectivity for route generation purposes.

Figure 9:
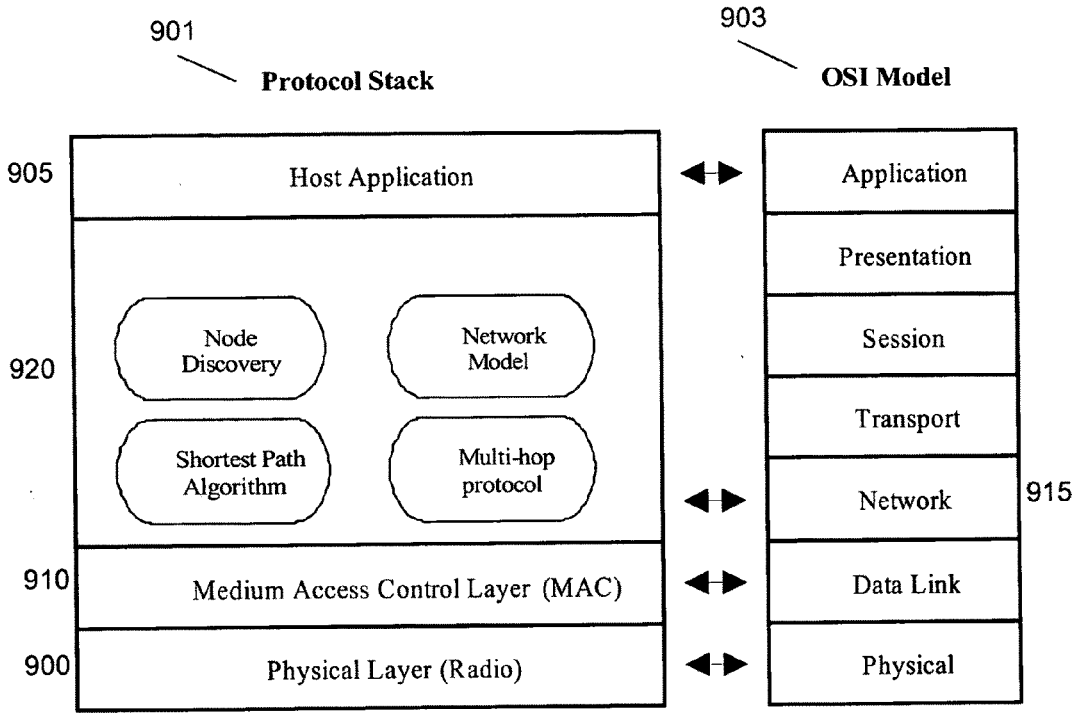
FIG. 9 illustrates a representative protocol stack for source routed multi-hop protocol in accordance with one or more embodiments.

Referring to FIG. 9, a representative protocol stack 901 for a source routed, possibly, multi-hop, protocol in accordance with one or more embodiments is illustrated. Prior to providing additional details of the route generation process, this example of a source routed multi-hop protocol that may be used in one or more embodiments will be described. Note however, that the methods, etc. do not rely on a specific multi-hop protocol. Instead, only the ability to send both source routed addressed messages and true broadcast messages are sufficient, with, e.g., the former used to reach a particular node for instructional or retrieval purposes and the latter for establishing the appropriate routes.

In this illustrated embodiment of the multi-hop communication protocol 920, a mechanism is provided for acknowledged communication between the local coordinator 510 and a node 400, which is reachable (via a route, etc.). All communications are initiated by the local coordinator 510, which determines the appropriate route for the outbound message and then writes into the message all the routing information necessary for its delivery. The multi-hop protocol provides functionality roughly equivalent to the network layer 915 as described in the standard Open Systems Interconnection (OSI) seven-layer model 903. It rides on a Media Access Control (MAC) layer 910 and Physical Layer 900 (provided by the RF wireless radio 346) that provides functionality on a par with the IEEE standard 802.15.4. Specifically, it uses a packet delivery system between network devices that are within RF range.

TABLE I

| Message ID | Message Type | Routing Table | Payload |
|---|---|---|---|

Table 1 shows an overview of one embodiment of basic message fields used in this multi-hop protocol. The Message ID field is used, e.g., to avoid the forwarding or processing of duplicate messages. The Message Type field indicates how the message should be processed which will be described in more detail below. The Routing Table field dictates the path that the message should follow beginning with the address of the source of the message, addresses for all intermediate routing nodes, and finally an address of the destination node. Nodes 400 processing outbound messages read this table in the forward direction, while nodes 400 processing incoming messages read the table in the backwards direction. A bit in the Message Type field is changed to indicate outbound or inbound. The Payload field contains the data that will be passed up to the application layer 905 upon delivery of the message.

Figure 10:
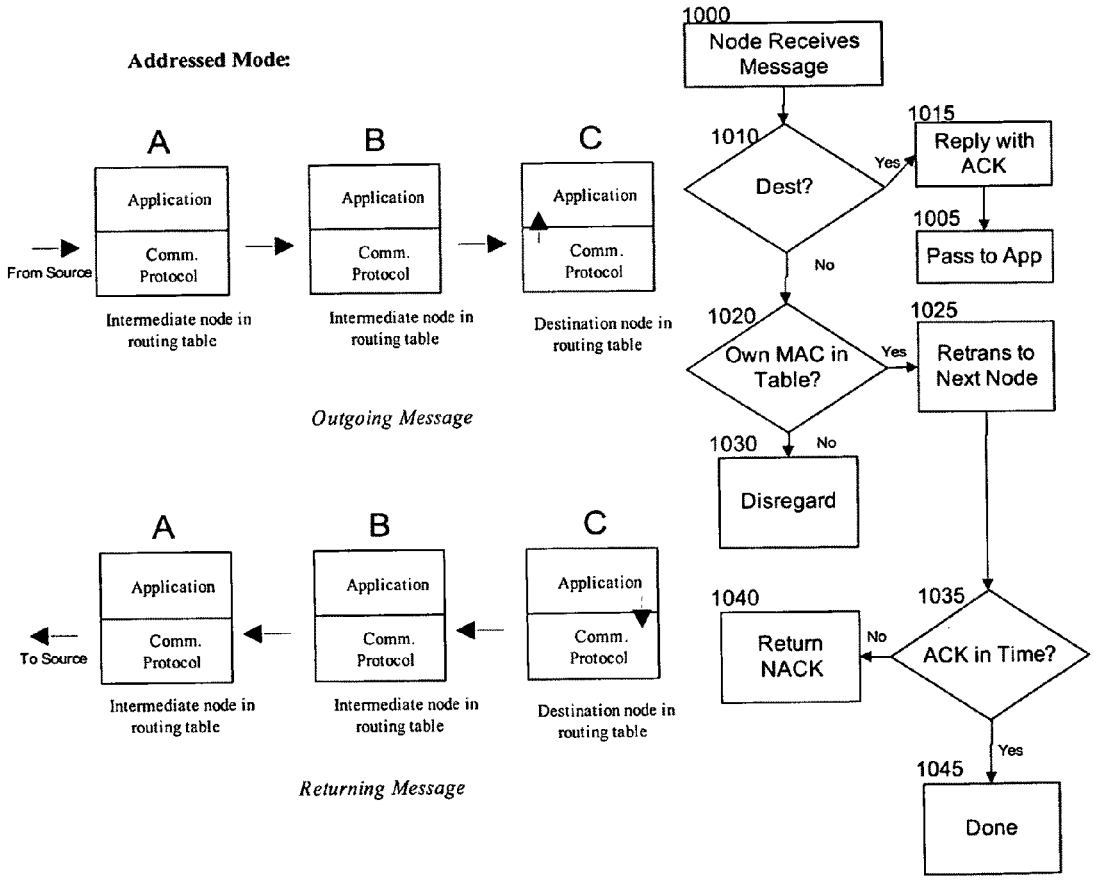
FIG. 10 illustrates a flow chart for one or more methods associated with addressed messages in accordance with one or more embodiments.
Figure 11:
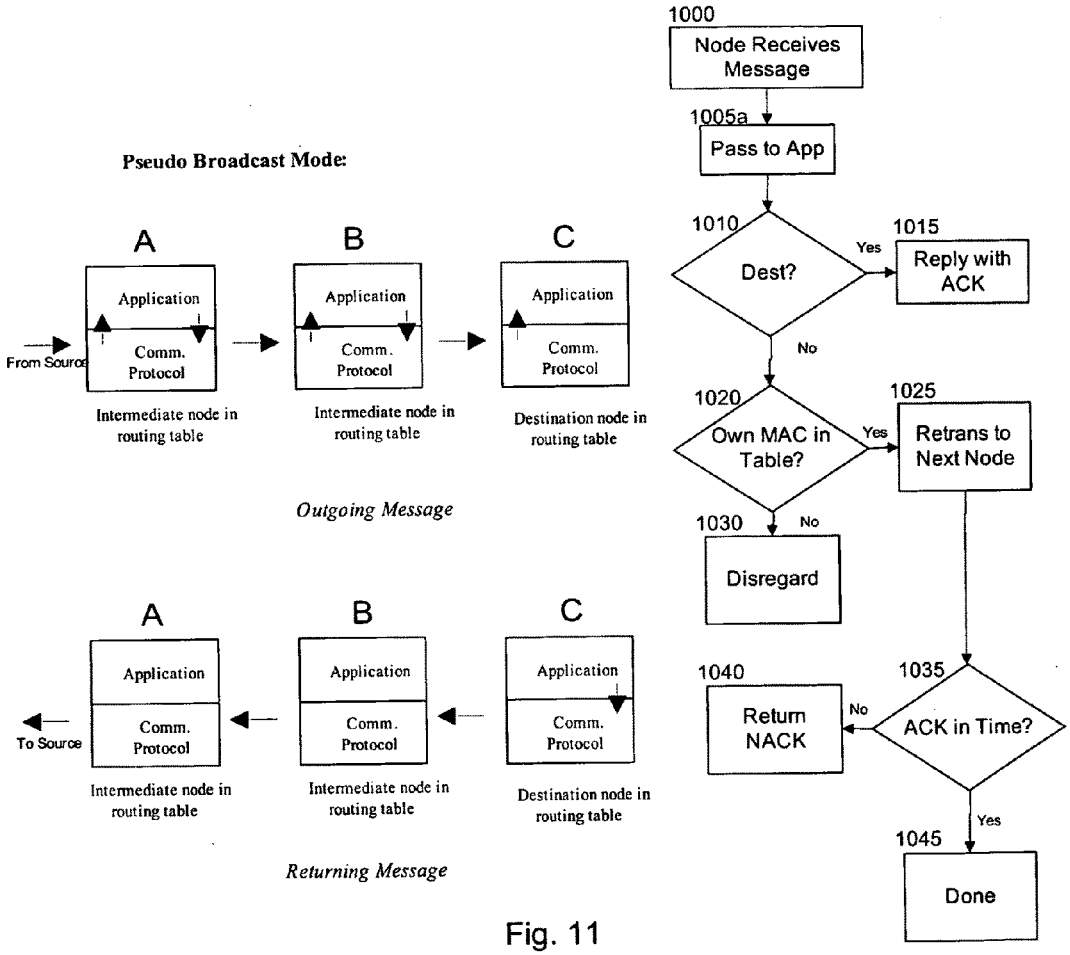
FIG. 11 illustrates a flow chart for one or more methods associated with pseudo broadcast messages in accordance with one or more embodiments.
Figure 12:
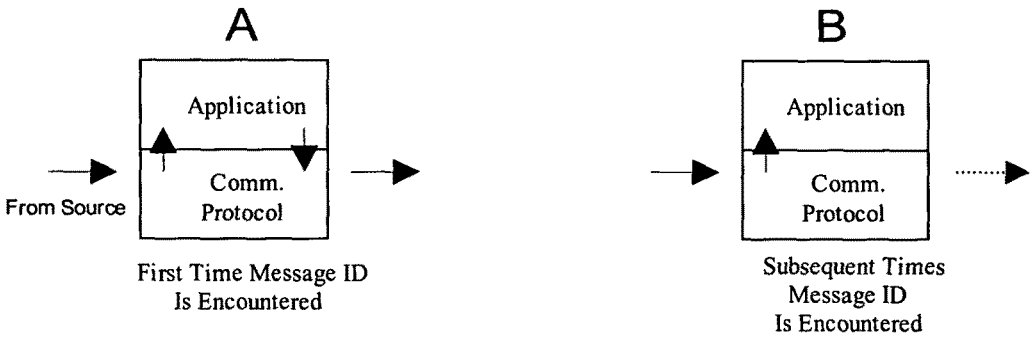
FIG. 12 illustrates a flow chart for one or more methods associated with broadcast messages in accordance with one or more embodiments.
Figure 12:
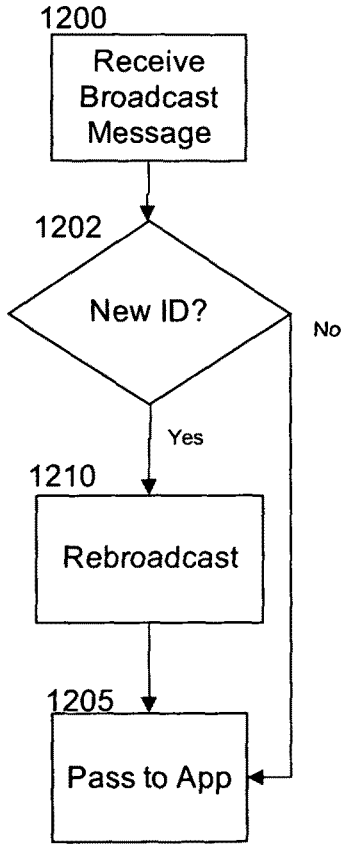

Three or more outgoing Message Types are supported: addressed, pseudo-broadcast, and true broadcast. FIG. 10 illustrates a flow chart for one or more methods associated with addressed messages in accordance with one or more embodiments and FIG. 11 and FIG. 12 show similar flow charts for pseudo broadcast and broadcast messages, respectively. Incoming Message Types: ACK and NACK can be considered addressed, but have special meaning. Table 2, below shows one exemplary bit pattern that can be used by nodes or coordinators to distinguish various message types, etc. In this example, when the leading bit is "1" it signifies inbound (see Addressed (response)) rather than outbound, which is denoted by "0" in the leading or left hand position. An addressed request can be, e.g., instructions for operating an addressed streetlamp (schedules, lighting levels, etc.) or a request for logs maintained by the addressed streetlight controller (operational information, sensor status, and the like). An addressed response can be information related to the request, e.g., the logs or an ACK or NACK. When a NACK is returned some scheme for identifying which node sent the NACK is needed for a multi-hop protocol. One approach is a bit field in the routing table whereby a bit is changed if an intermediate node in a route received the message. Another approach is to change the routing table for the NACK wherein all addresses after the source of the NACK are set to some value, e.g. "0" by the source. As suggested in Table 2 (see Process at "A" or "B" Nodes), bits in the Message Type field can be used to designate particular types of nodes. Using this message format allows a local or central coordinator to indicate that packets in the accompanying message should be processed only by the specified type of nodes (e.g., A or B, etc.). Thus messages can be directed only to nodes having certain characteristics (e.g., streetlight wattage, origin of streetlight or type of streetlight, street location, etc.).

TABLE 2

| Message Type Bit Pattern | Message Type |
|---|---|
| 00000001 | Broadcast |
| 00000010 | Pseudo Broadcast |
| 00000100 | Addressed (request) |
| 10000100 | Addressed (response) |
| 00001000 | Process at "A" Nodes |
| 00010000 | Process at "B" Nodes |

In FIG. 10 and FIG. 11, nodes 400 are shown in the outbound sequence expected by the route, i.e., from source to A to B to C. For an inbound ACK message the sequence is C to B to A to the source. In addressed and pseudo-broadcast mode, when a node 400 receives a message (block 1000), it first checks to see if it is the destination of the message (block 1010), i.e., as illustrated in FIG. 10 node C is the destination. If it is, the message is passed to the application layer (block 1005) and then the node 400 replies with an acknowledgment (block 1015). If it is not the destination, it looks for its own Media Access Control (MAC) address in the routing table (block 1020). If it finds it, then it re-routes the message on to the next entry in the table (block 1025) (see node A, B). The node 400 then waits for an acknowledgement (block 1035). If this re-routing or relaying fails; i.e. after some number of attempts no acknowledged communication occurs with the next node in the routing table, then the node sends a NACK message (with an indication of source of the NACK) back to the coordinator via the address entry immediately before its own entry in the routing table (block 1040). If the node is unable to find its MAC address in the routing table and it is not the destination, then it disregards the message (block 1030). An ACK or other response from the next entry in the table is treated the same as any other message. In broadcast mode, all messages received with a unique Msg ID are re-broadcast.

Whether the message is passed up to the application layer depends on the message type. In the addressed mode, the message is passed from node 400 to node 400 until it reaches the destination (see node C in FIG. 10). At this point the message is passed up to the application layer for processing, and a response is sent. The response (i.e., ACK, neighbor table, informational logs, or other response) functions as an acknowledgement and signals to the local coordinator 510 that the message was successful. Pseudo-broadcast functions in a similar manner to the addressed message, but the message is passed up to the application layer by each intermediate re-routing node 400 (block 1005*a*). However, only the destination node (end node) 400 acknowledges the message. This mode provides a mechanism for a message to reach to a number of nodes 400 without the overhead of addressing the message to each one in turn. In true broadcast mode when a message is received (block 1200), each node 400 that has not seen a message of this ID (block 1202) rebroadcasts it (block 1210) and passes the message up to the application layer (block 1205); whereas messages with IDs that have been seen before are merely passed up to the application layer without being rebroadcast.

Figure 13:
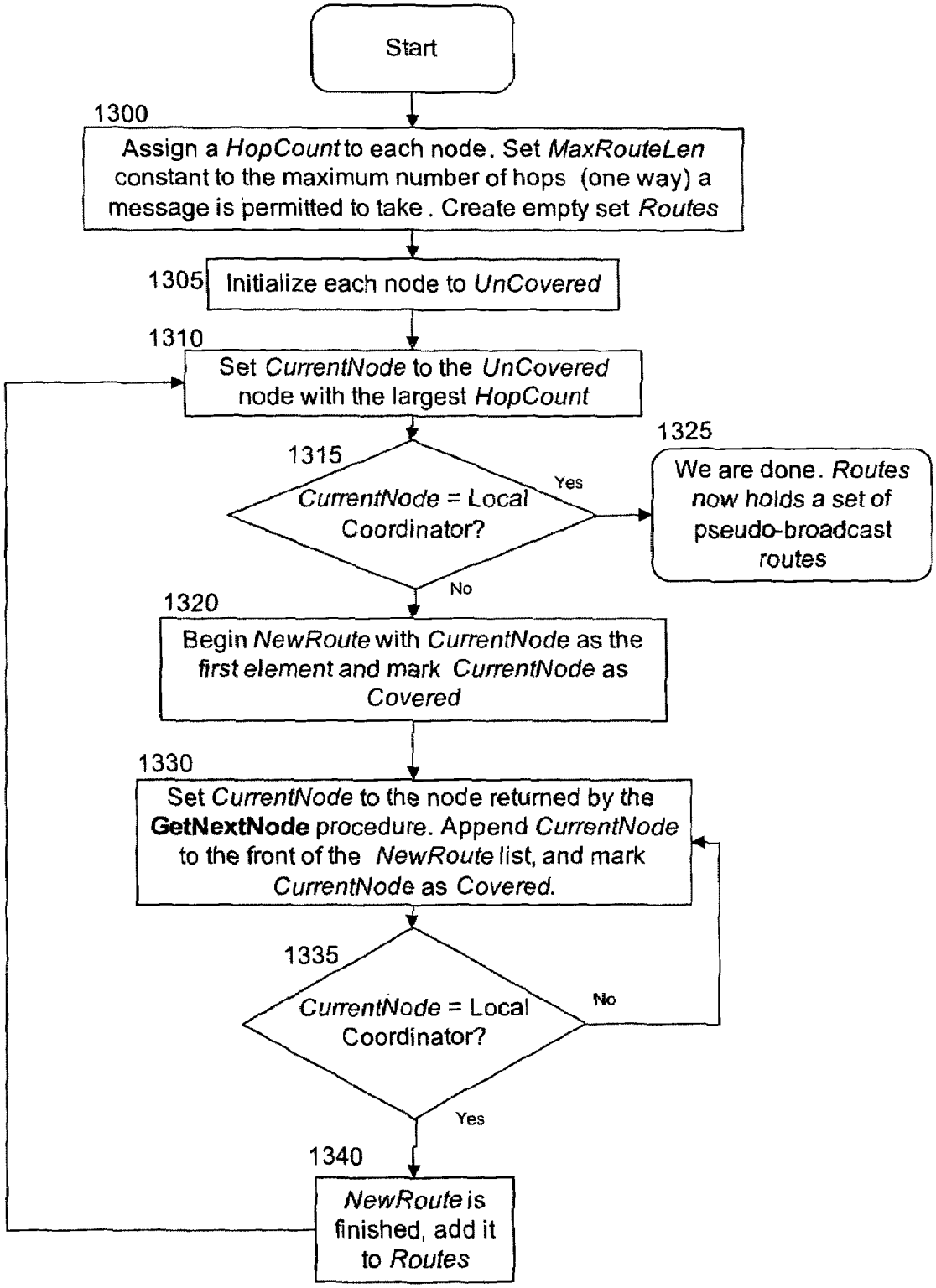
FIG. 13 and FIG. 14 show representative methods for generating broadcast routes in accordance with one or more embodiments.
Figure 14:
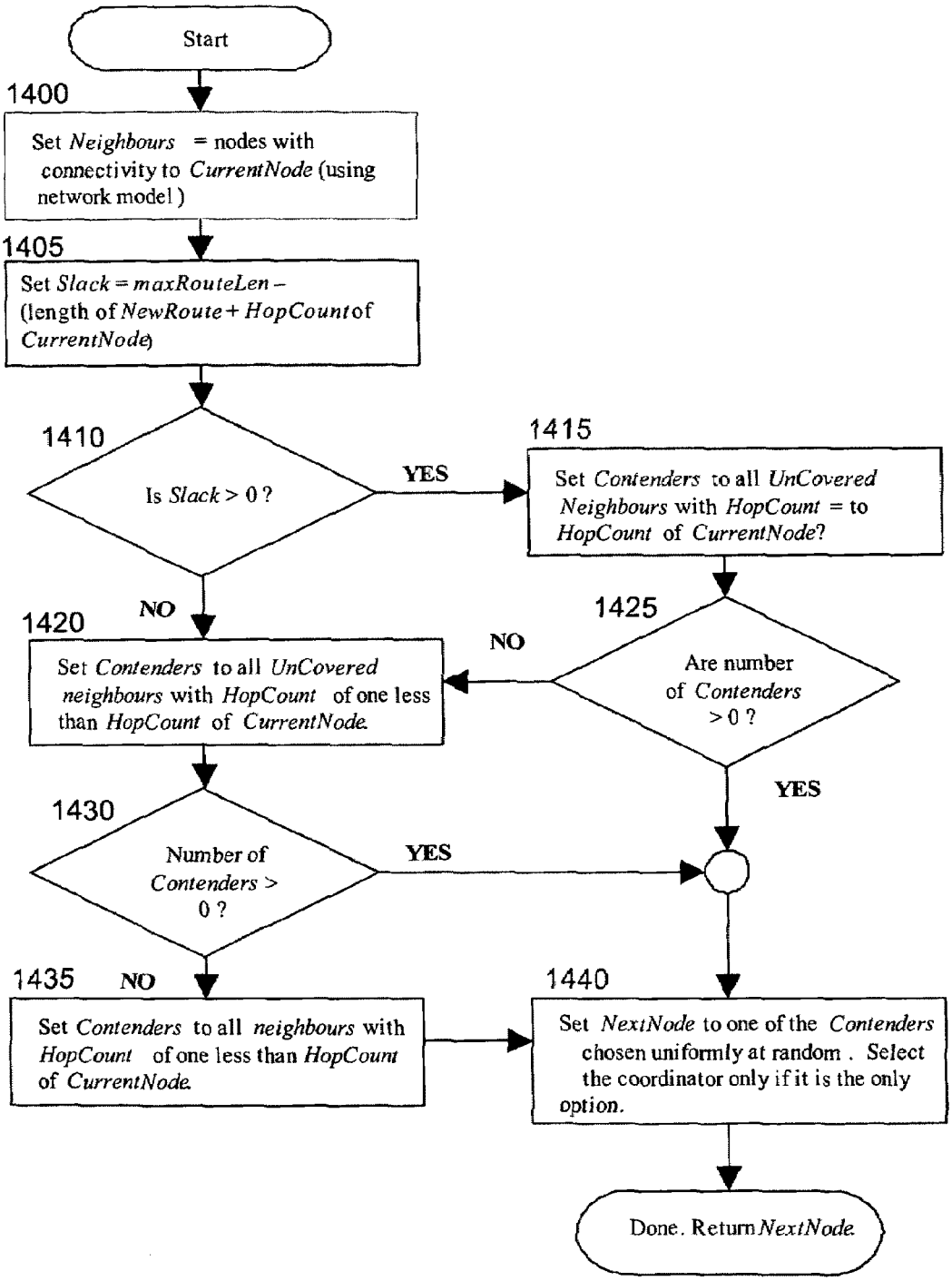
Figure 15A:
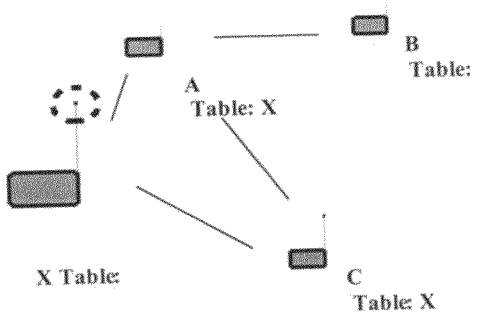
FIG. 15*a*-FIG. 15*d* illustrates broadcast discovery from a system perspective in accordance with one or more embodiments.
Figure 15B:
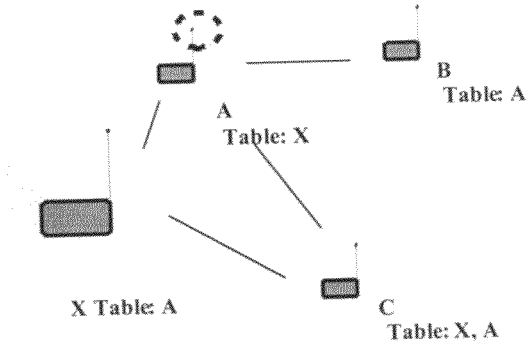
Figure 15C:
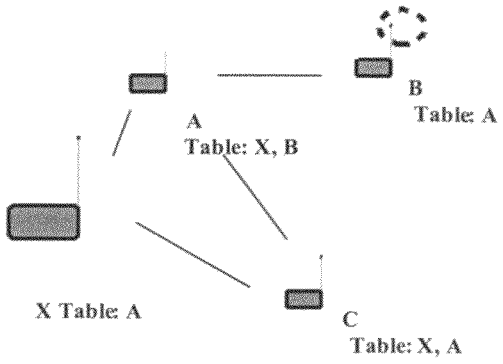
Figure 15D:
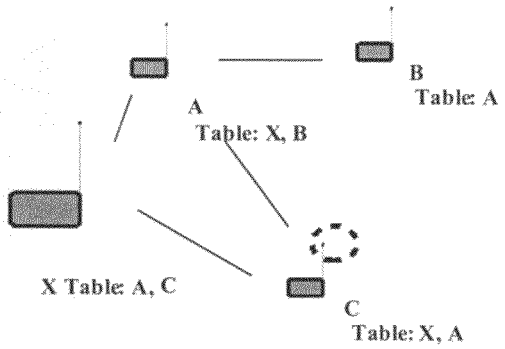

Referring to FIG. 13 and FIG. 14, representative methods for generating broadcast routes in accordance with one or more embodiments will be discussed and described. Using the protocol and procedures of FIG. 10 a message can be addressed to and thus delivered to any of the nodes 400. If the same or similar message (lamp ON or OFF or maximum light level or same instruction messages) needs to be delivered to all or many nodes within a subnet, a pseudo broadcast message can provide savings. Thus, in one or more embodiments, the multi-hop protocol has the capability of delivering payloads in a pseudo-broadcast manner (FIG. 11). In this mode, messages are processed at all nodes as well as forwarded by intervening nodes to or toward the destination node. This technique can be used to deliver a common message to all nodes 400 in a subnet or the network using fewer messages than would otherwise be necessary to communicate to each node 400 individually in an addressed manner. The problem of interest when using the pseudo-broadcast feature for this purpose is generating a set of routes that provides coverage of all the network components, with the coverage using minimum effort. Here the term minimum effort can be quantified by an objective function that specifies effort in terms of transmission time, power consumption or some other metric.

For example, consider generating a set of routes that minimizes the time taken to deliver a message to each of the nodes 400 with a valid routing path to the local coordinator 510. This problem is difficult to solve optimally, however, heuristic approaches are capable of finding near-optimal solutions to this problem. Any suitable approach could be applied by our technique. In the remainder of this section we give an example of one embodiment of such a route generation process.

The following approach generates a set of pseudo broadcast routes that provide network coverage, i.e., at least one route touches or is touching each of the nodes, by going to each node and in many instances going through (being forwarded or relayed by) the respective node. The process assumes a connectivity matrix populated with zeros or ones only for the connectivity weights (strengths, costs, probabilities, quality information, etc.). Note, however, that such a model could easily be obtained from a probabilistic connectivity description through the use of a simple threshold (for example all values of 0.7 or greater in the connectivity matrix may be assigned to probability 1.0 and values lower than 0.7 may be assigned probability 0.0). Furthermore, a maximum desired route length for a message (e.g., 3, 4, 5, etc.) must be specified. Given these inputs the method proceeds as illustrated in FIG. 13 and FIG. 14 and enumerated and discussed below.

1) Using the network model to construct a graph, enumerate each of the nodes outwards from the coordinator in a breadth first fashion in order to keep track of how many communication links each node 400 is from the local coordinator 510; i.e.; the shortest required multi-hop message necessary to communicate from the local coordinator 510 to the node 400 in question. Call this a hop count. Select, in addition, the maximum number of hops we desire a message to take and assign this value to maxRouteLen and create an empty set of routes (block 1300).

2) Set each node in a data structure to uncovered (block 1305).

3) Select the uncovered node with the largest hop count as the CurrentNode (block 1310). Break ties arbitrarily; (i.e. any node may be selected among those with an equally large hop count), but do not select the coordinator unless there is no other option. If CurrentNode is the coordinator (block 1315) then the generation of pseudo broadcast routes is complete (block 1325). Otherwise initialize a NewRoute which will ultimately hold the multi-hop path between the CurrentNode and the coordinator (block 1320) and set CurrentNode as the first element of the route.

4) Generate a potential list of neighbours for CurrentNode (block 1330, block 1400 of FIG. 14) and set hopCnt to the hop count of the currentNode and calculate the slack=maxRouteLen−(length of NewRoute+hopCnt) (block 1405).

a) If slack=0 (block 1410), and there is an uncovered neighbour hopCnt-1 hops from the coordinator available then select this neighbour; select uniformly at random one if there is more than one, (block 1420, 1440). Otherwise select a covered neighbour of hopCnt-1; select uniformly at random if there is more than one (block 1435, 1440).

b) Otherwise, if slack>1 and there is an uncovered neighbour of the same hopCnt then select this neighbour (block 1415); select uniformly at random if there is more than one (block 1415,1440). Otherwise proceed as if slack=0 (block 1425).

c) Assign CurrentNode variable to the selected neighbour (block 1330).

5) Mark CurrentNode as covered and append this to the front of the NewRoute list (block 1330). If CurrentNode is the coordinator, then NewRoute is complete and is added to the list of pseudo broadcast routes (1340). In this case, repeat the process to generate another route (block 1310), otherwise set CurrentNode to NextNode and go to Step 4 (block 1330)

In another embodiment of the invention, the pseudo broadcast routes determined by the above described process could be further refined by employing a Monte Carlo post processing technique, or alternately a Monte Carlo technique such as simulated annealing could be applied directly to this route generation problem.

Next a detailed description of the auto-discovery process is provided and this is followed by a description of route generation process. In order to build up the routing tables needed to reach each node 400, the local coordinator 510 maintains a model of the network connectivity. This is done via a broadcast based discovery process. In the multi-hop protocol described above, this can be done using a message sent in the broadcast mode (see FIG. 12). The first step taken by the coordinator is to broadcast a "discovery" message. This message puts a recently unused value in the message ID field, sets the Message Type field to broadcast, and puts only the source MAC address of the coordinator itself in the Routing Table field.

Upon receiving this broadcast message, each receiving node 400 enters the source address in a locally maintained neighbor table. If it has not recently received this message based on a message ID filtering scheme, then it writes its own MAC address into the Routing Table field and re-broadcasts it some number of times (k), with a delay preceding each broadcast. This delay, or random back off period (t) should be of a sufficient length so as to make the possibility of collisions acceptably small. Likewise the number of broadcast attempts, k, should be balanced against the random back off period, t, in order to select a high probability of transmission success. The actual value of t and k, should be selected depending on the predicted worst case density of nodes and the time it takes to broadcast the discovery message.

For example, if a node 400 has n neighbors, then for k=1, a random back off period t, and a transmission time z, then the probability of the node 400 successfully rebroadcasting the message without a collision is approximately:

$$\text{prob_success} \approx [(t-2z)/t]\hat{}(n-1),$$

since a potentially interfering transmission must not begin within the transmission time of the first transmission, or during it. Given this formula and an acceptable probability of success, an appropriate value for t can be found. For example if the maximum number of neighbors n is around 50, a probability of success of 80 per cent is deemed acceptable, and transmission time z=50 msec, then a random back off time t of a little more than 22 seconds should be selected. If rebroadcast episodes are synchronized by adjusting the back off time based on the rebroadcast attempt so that waves of broadcasts from different retries are non-overlapping, then the previously stated prob_success is increased for higher values of k.

In one embodiment of the invention, the following hash function is used as a mechanism for selecting the random back off time:

$$\text{back_off_time}=[(\text{seed XOR radio_identifier}) \text{ MODULO } M]*(1/8)\text{second},$$

where seed is an integer value that should change during a particular calculation of a random back off time, radio_identifier is an integer value unique to each node, and M is a prime number. For example, seed could be the least significant bits of a clock maintained by the host node, and radio_identifier could be the MAC address of the radio used by the host node. The point of this hash function is to select a node and time dependent pseudo-random delay that is used to randomize broadcast attempts.

The broadcast discovery message will propagate outwards from the coordinator, and should reach every node for which there exists a reliable single or bounded multi-hop communication route to the coordinator. Alternately, the propagation of the broadcast message could be limited to a desired hop radius. This could be accomplished, for example, by augmenting the protocol to include a "time to live" (TTL) field in the message header. The initial broadcast message sent from the coordinator would set this field to the desired hop radius. Upon receiving the message, each node 400 would decrement the TTL value and only processes the message if the value remains positive.

In one embodiment of the invention, a mechanism may also be implemented to screen out messages sent over links that were deemed unreliable. For example, upon receiving a valid broadcast message, a node may compare the received signal strength of the message with a threshold and process it only if the threshold was exceeded. Another mechanism would be to store up to a determined number of broadcast messages received from each neighbour and process the message only if the average received signal strength of the messages from this node exceeded a threshold. This may exclude from the internal neighbour table those neighbours connected via poor links. In addition or alternatively, a subset of neighbors, e.g., predetermined number of neighbors, with the highest or best received signal strength may be selected for further processing, e.g., inclusion in the neighbor list. At the end of the propagation of the broadcast discovery message each node connected to the coordinator by a reliable connectivity link should have a locally maintained list of neighbors. This list of neighbors could be enhanced by an indicia of quality, e.g., related to observed signal strength, if desired.

Referring to FIG. 15*a*-FIG. 15*d*, an exemplary broadcast discovery from a system perspective in accordance with one or more embodiments will be discussed and described. FIG. 15(*a*)-(*d*) shows an example of the broadcast discovery process described above for a 4 node network with k=1. The local coordinator 510 X begins the process by broadcasting a discovery message (FIG. 15(*a*)) with itself as the source. X is recorded in the neighbour tables of node A and C when they receive this message. Node A then rebroadcasts the message with itself as the source after its random back off time expires (FIG. 15*b*) and neighbors X, B and C record A in their respective neighbour tables. Node B then rebroadcasts the message with itself as the source after its random back off time expires (FIG. 15*c*) and neighbor A records B in its neighbour table. Finally, Node C rebroadcasts the message with itself as the source after its random back off time expires (FIG. 15*d*) and neighbors X and A record C in their respective neighbour tables. Now these tables can be collected by the coordinator and used for generating routes.

Figure 16:
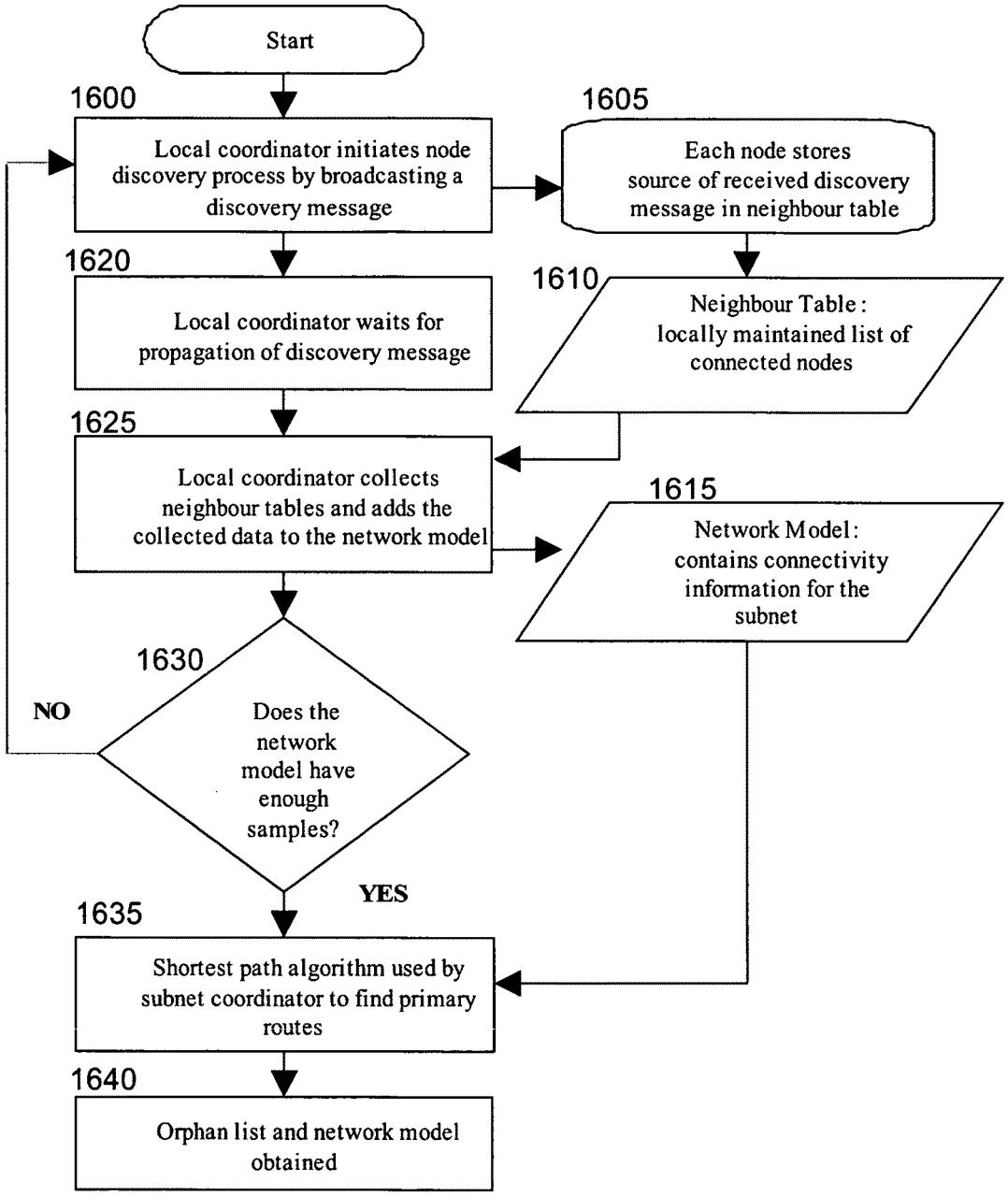
FIG. 16 illustrates a flow chart of various methods of auto discovery in accordance with one or more embodiments.

Referring to FIG. 16, a flow chart of various methods of auto discovery in accordance with one or more embodiments will be discussed and described. FIG. 16 outlines the set of steps taken during the auto discovery process and some of this discussion will be a repeat of various points made above.

First, the local coordinator 510 initiates the node discovery process by broadcasting a discovery message (block 1600). While the subnet coordinator waits for the propagation of the discovery message (block 1620), each node 400 stores the source of received discovery messages in its neighbor table (block 1605). Once propagation of the discovery message has ended, the neighbor table in each node 400 contains a locally maintained list of connected nodes (block 1610). The local coordinator 510 then collects these neighbor tables using normal addressed messages (block 1625). This adds information to the network model in the local coordinator 510 (block 1615). If the network model has enough information for all nodes 400 in the network (block 1630), a shortest path algorithm is used to find primary routes to each node 400 (block 1635). If not, execution continues at block 1600. A list of orphans may also be identified (block 1640).

Figure 17:
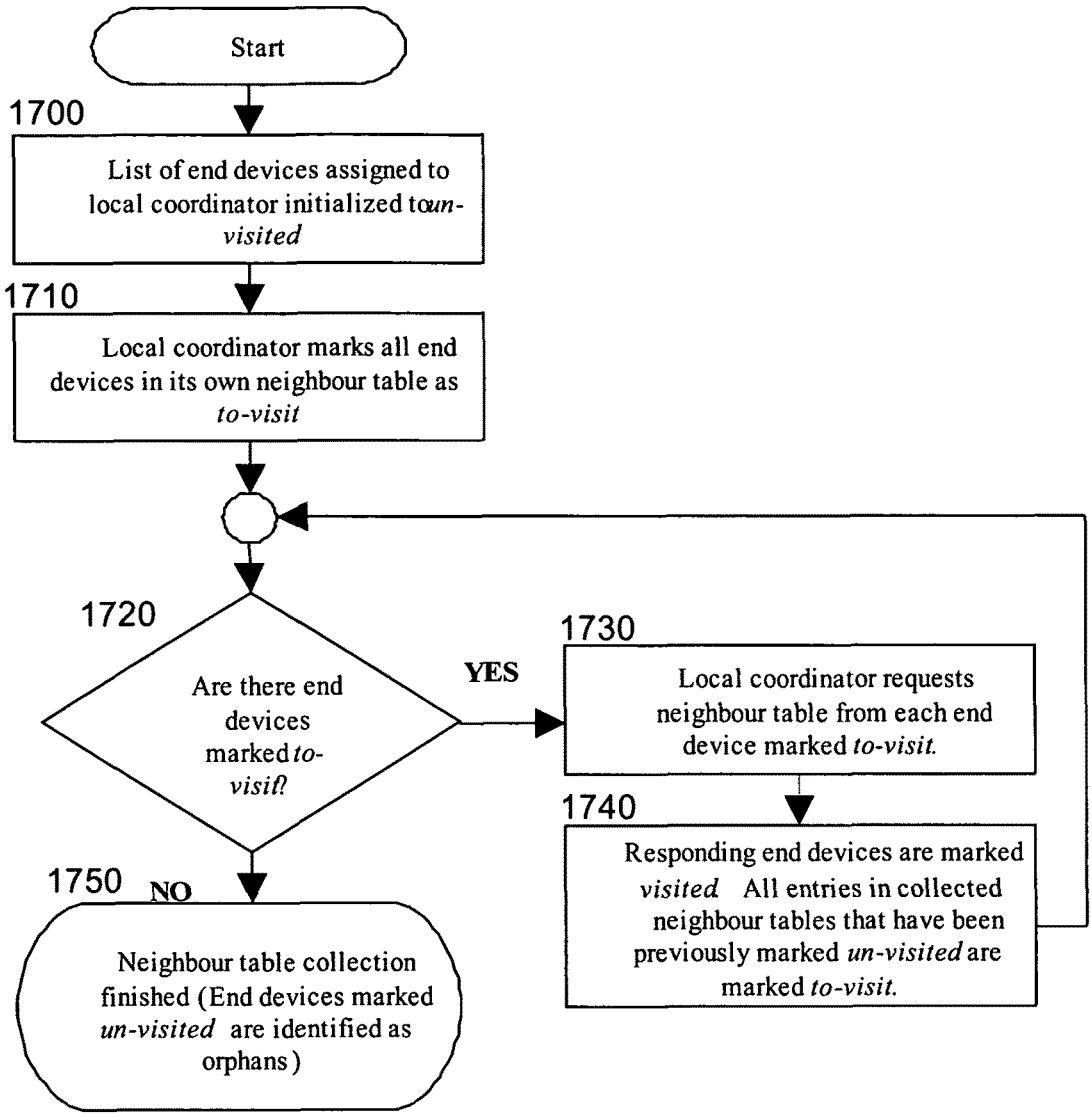
FIG. 17 depicts a flow chart of various methods of communicating between a local coordinator and discovered nodes in accordance with one or more embodiments.

Referring to FIG. 17, a flow chart of various methods of communicating between a local coordinator and discovered nodes in accordance with one or more embodiments will be discussed and described. After a suitable delay, based on the maximum number of expected hops, hmax, in the network, the maximum random back off period, tmax, and the broadcast attempts k, the local coordinator 510 sends a message to each of the nodes in turn and asks it for its list of neighbors. This delay can be calculated according to the following formula:

$$\text{collection delay}=h\max*t\max*k$$

Beginning with the nodes that are in direct connectivity, (i.e. reachable via a single RF hop, where these nodes will be known to the local coordinator from its table), to the local coordinator 510, the local coordinator 510 sends a message to each node asking for its temporarily stored neighbor table. These tables are then amalgamated into a model of the network connectivity, which then allows routes to be found for subsequent nodes. During the remainder of the neighbor table collection process, the local coordinator 510 communicates with each of the discovered nodes using the method described in the flow chart shown in FIG. 17. First the list of devices assigned to the local coordinator 510 is initialized to "unvisited" (block 1700). The local coordinator 510 marks all nodes 400 in its own neighbor table as "to visit". If there are nodes 400 listed as "to visit" in the table (block 1720), then for each node 400 so marked, the local coordinator 510 requests the neighbor table from that node 400 (block 1730), marks any responding nodes as "visited" and marks all the previously marked "unvisited" nodes in the table retrieved as "to visit". When there are no longer any nodes 400 listed as "to visit" at block 1720, the local coordinator 510 identifies any nodes 400 that are still marked "unvisited" as orphans. The neighbor tables recovered from the network components are then used to build up a model of network connectivity.

In one embodiment of the invention, the node discovery process could be carried out periodically to track current RF communication conditions, and the network model link strengths assigned either a probability of zero or one depending on neighbor table entries (i.e., probability assigned 1 where two nodes 400 are neighbors and 0 if not). In another embodiment of the invention, the entire discovery process described above could be repeated a number of times and the results averaged to build up a probabilistic estimate of inter-node link strength. Standard graph algorithms could then be used to find a near-optimal or optimal route to each reachable network component given the employed model of connectivity.

The primary, shortest path route is cached by the local coordinator 510 and is used for routine communications. If this route fails, (possibly after some number of retries), a new route may be generated based on what information is available regarding the failure. For, example, if the multi-hop protocol described above was employed, it's possible that a NACK was returned that indicates at which link the communications failed, otherwise, all involved links could be suspected/questioned.

Figure 18:
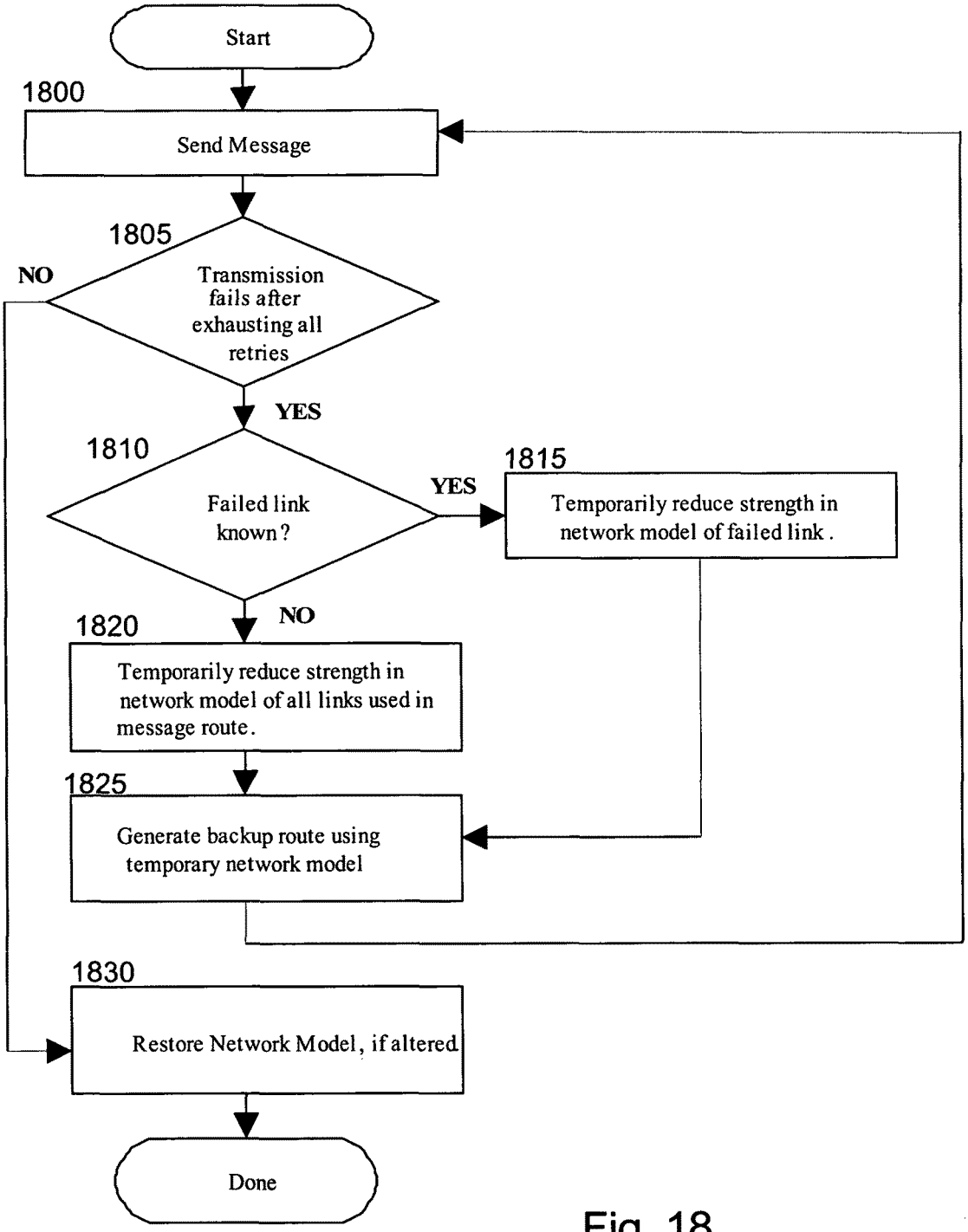
FIG. 18 shows a flow chart of methods of generating back up routes in accordance with one or more embodiments.

Referring to FIG. 18, a flow chart of methods of generating back up routes in accordance with one or more embodiments will be discussed and described. The flow chart shown in FIG. 18 describes an example of one method that could be used for generating back up routes in the event that communication using the primary route fails.

First the local coordinator 510 sends a message (block 1800). If transmission fails after exhausting all retries (block 1805), the computing logic 700 determines whether the failed link is known (block 1810). If the link is known, the strength of the failed link is temporarily reduced (probability of communication via that link is decreased or the cost associated with communication via that link is increased) in the network model (block 1815). If the failed link is not known, the strength of all links in the message route are temporarily reduced in the network model (block 1820). A backup route is then generated using shortest path graph algorithms such as Dijkstra's based on the temporary network model (block 1825) and the message is resent using this backup route (block 1800). When the transmission no longer fails (at block 1805), the network model is restored/saved with any modifications in link strength (link probabilities or costs), i.e., the back up route becomes the primary route (block 1830).

In another embodiment of the invention, a backup route could be prepared offline along with the primary route. The backup route could be constructed so as to avoid as many of the nodes used by the primary route as possible. The backup route could then be attempted after the failure of the primary route, before the regeneration of routes as described above.

In one embodiment of the invention, routine updating of the network model could be carried out opportunistically during regular operations. For example, through an exponential averaging technique or by maintaining a table of attempts versus successes for each link. If using exponential averaging, each link that was used successfully, or unsuccessfully, could have its associated link strength updated using the following formula:

$$\text{new_link_strength}=(1-\text{alpha})*\text{old_link_strength}+(\text{alpha})*\text{new_measurement},$$

where alpha determines the update rate, and new measurement is set to either a 1 or a 0 depending on the observed transmission behavior over the link in question. The update rate alpha is a value between 0 and 1 that indicates how much weight to put on historically obtained values, and how much weight to place on recently obtained measurements In another embodiment of the invention, all link_strengths in the network model, as described above, could be periodically increased by a small amount. For example, every day, or after some number of communication attempts per node, each link could be increased according to the following formula:

$$\text{new_link_strength}=(1+\text{beta})*\text{old_link_strength},$$

where beta is a value close to zero that indicates the "healing rate". Such a "mesh healing" mechanism would allow the system to retry links that were previously found to be broken, giving some roubustness to shifting radio frequency conditions.

In another embodiment of the invention, the network model could also maintain a probabilistic belief of which nodes in the system are active and use this belief to modify the link strength of any links connecting to that node 400. For example, a parameter node_health that ranged from 1, indicating good health, to 0, which indicates a bad or non-active node could be used. The link_strength, as described above, of all links connected to the node 400 in question could be multiplied by the node_health parameter. The node_health parameter could be updated opportunistically during regular operations. When a message failed on a link connected to this node 400, the node_health value would be decreased, e.g. through an exponential averaging process as with the link strengths or via some other mechanism. On the other hand, a successful routing through, or communication with, this node 400 would immediately increase its value to 1 since it is active.

Thus we have discussed and described a streetlight controller 102 (node 400) for monitoring and controlling a streetlight. The streetlight controller includes one or more switches operative to control a load (lamp brightness, etc.) and one or more sensors (day night, lamp, voltage, etc. sensors) that are operative to monitor the operation of the load and other variables. The streetlight controller also includes a processor or microcontroller coupled to the switch(es) and sensor(s) and further includes a radio transceiver coupled to the processor. The radio transceiver can receive data via an addressed message where the message includes a control action (lamp on off, brightness setting, schedules, etc.) associated with the switch(es) and transmit data representing a state of one or more sensors or other information (operational logs for the streetlight). The transmission of data is typically responsive to an addressed message requesting the same as interpreted by the processor.

The processor is further operative to maintain a list of addresses of, respective neighbor streetlight controllers, etc. and in cooperation with the radio transceiver, transmit the list of addresses to a coordination device (local coordinator) which is a remote device, where transmitting the list of addresses is typically responsive to receipt of a message from the coordination device requesting the list of addresses. Additionally the radio transceiver is operative to receive a first broadcast message comprising an address associated with a transmitter (another streetlight controller or the coordination device) that transmitted the first broadcast message and to transmit a second broadcast message containing an address of the streetlight controller. When the first broadcast message is received, the processor is operative to determine whether the address associated with the transmitter of that message is included in the list of addresses and, if not, to add the address associated with the transmitter to the list of addresses. The processor is operative to add each unique address of streetlight controllers, from which broadcast messages have been satisfactorily received, to the list of addresses and in this manner maintain the list of addresses.

The processor in one or more embodiments is operative to assess a quality of each of the broadcast messages (received signal strength or the like) to ascertain whether each, respective, broadcast message was satisfactorily received and thus whether the respective address should be added to the table or list of addresses. In other embodiments, the processor is operative to assess an average quality of a plurality of copies of each of the broadcast messages to ascertain whether each, respective, broadcast message is satisfactorily received and hence whether the associated address should be added to the table or list. In other embodiments the processor adds up to a predetermined number of addresses associated with the strongest broadcast messages that are received.

The processor can be operative to delay the transmit of the second broadcast message for a random back off time period. The processor cooperatively with the radio transceiver can repeat the transmit of the second broadcast message a predetermined number of times, e.g., 3 times. In some embodiments, the transmit of the second broadcast message is conditioned on whether the first broadcast message includes a new message identification.

In varying embodiments, the transceiver is operative to receive a message addressed to the streetlight controller and the processor is operative to determine, from the message, the route for the message, e.g., from the routing table in the message and the bit setting outbound or inbound. The processor in cooperation with the transceiver will forward the message to the next transceiver associated with the next address based on the route for the message, unless a destination for the message is the streetlight controller. If the streetlight controller is the destination and the message is successfully received the processor with the radio transceiver will reply with an ACK message and the same routing table with the message direction bit set to inbound.

From a larger perspective, a system for monitoring and controlling streetlights has been discussed and described. In varying embodiments, the system comprises a multiplicity of streetlight controllers communicably coupled to one or more local coordinators with these in turn coupled to a central controller.

Each streetlight controller further comprises one or more switches operative to control the operation of a load (e.g., ballast and lamp), one or more sensors operative to monitor the operation of the load (light levels, temp, etc.) or environment, at least one processor coupled to the switch(es) and the sensor(s), and a radio transceiver coupled to the processor and operative to receive data representing a control or monitoring action associated with the streetlight controller and transmit data associated with the streetlight controller. The local coordinator is remotely located relative to the streetlight controller in most instances and further comprises a coordinator radio transceiver, and a coordinator processor coupled to the coordinator radio transceiver. The coordinator processor is operative to, among other functions, maintain a list of the multiplicity of streetlight controllers and, cooperatively with the coordinator radio transceiver, operative to exchange messages with any of the multiplicity of streetlight controllers.

The coordinator processor is further operative in varying embodiments to maintain a connectivity model for the list of the multiplicity of streetlight controllers, the connectivity model comprising, for each of the multiplicity of streetlight controllers, a list of addresses of neighbors and, respective, link quality information and to further generate a route from the local coordinator touching (going to or through) each of the multiplicity of streetlight controllers based on the connectivity model, e.g., using a shortest path algorithm. Thus, the coordinator processor is operative to generate a set of routes from the local coordinator to the multiplicity of streetlight controllers with at least one route going to each of the multiplicity of streetlight controllers, typically with many routes going through intervening streetlight controllers. For the portion of the routes in the set of routes that include two or more of the multiplicity of streetlight controllers, the coordinator processor is operative to indicate in a message for transmission over a route of or out of the portion of routes, which of the two or more of the multiplicity of streetlight controllers should process a payload in the message, i.e., only the destination for an addressed message, only a particular type of node (e.g., "A" nodes), or the destination as well as intervening controllers for pseudo broadcast messages.

In varying embodiments, the system is dynamic, i.e., is automatically or autonomously updated from time to time, e.g., periodically, opportunistically (not otherwise occupied), according to some schedule, or the like.

This can include approaches wherein the coordinator processor is further operative to adjust the connectivity model based on a history of message transmission via one or more of said each of the multiplicity of streetlight controllers, i.e., enhancing the connectivity links that are being successfully used and decreasing the links which are not being used. Application of the connectivity model and shortest path algorithm can thus result in finding new routes that can be tried and thereby the model, etc. will track changes that are occurring in the system. In one approach, the coordinator processor is operative to use exponential averaging to adjust the connectivity model, specifically, respective links. In other embodiments, the coordinator processor is further operative to adjust the, respective, link quality information for all links in the connectivity model, thereby allowing new routes to be attempted, i.e., link probabilities can be increased or link costs can be decreased or vice-versa, thereby allowing new routes to be attempted.

From the coordinator or local coordinator perspective and somewhat in the nature of review of some of the above discussion, the coordinator comprises a radio transceiver and a processor coupled to the radio transceiver. The processor is operative or operable to maintain a list of the multiplicity of streetlight controllers, to generate a route from the local coordinator to each of the multiplicity of streetlight controllers, and, cooperatively with the radio transceiver, to send messages to and receive messages from any of the multiplicity of streetlight controllers. In various embodiments, the processor is thus operative to maintain a connectivity model for the list of the multiplicity of streetlight controllers, the connectivity model comprising, for each of the multiplicity of streetlight controllers, a list of addresses of neighbors and, respective, link quality information, and to generate a route from the coordinator to each of the multiplicity of streetlight controllers based on the connectivity model using, e.g., a shortest path algorithm.

In part this may entail, the coordinator, more specifically, the processor cooperatively with the radio transceiver conducting a streetlight controller discovery process pursuant to maintaining the connectivity model. In some embodiments, the discovery process further comprises: transmitting a first broadcast message including an address for the coordinator (as described above this will result in broadcast message rippling throughout the streetlight controllers); responsive to the transmitting, receiving second broadcast messages, each of the second broadcast messages including an address for a, respective, streetlight controller that transmitted the, respective, second broadcast message, saving each unique address in the second broadcast messages; transmitting an addressed message to each unique address, the addressed message requesting a list of neighbor addresses from each streetlight controller associated with each unique address; receiving the list of neighbor addresses from each streetlight controller that was so addressed and identifying new addresses; and transmitting additional addressed messages to each, respective, new address, receiving a corresponding list of neighbors, and identifying, corresponding new addresses until there are no new addresses.

As noted above one or more learning processes can be exercised. The processor can be operative to adjust the connectivity model to reflect a health parameter for each of the multiplicity of streetlight controllers, the health parameter used to vary the link quality information for links associated with a corresponding streetlight controller, i.e., all links to a particular streetlight controller are varied or adjusted in some manner, e.g., quality increased for recently used controllers or decreased for idle controllers. The processor can be operative to adjust the connectivity model based on a history of message transmission via one or more of each of the multiplicity of streetlight controllers. The processor can apply exponential averaging wherein history of use or other information is used to adjust the connectivity model. The processor can be operative to adjust the, respective, link quality information for at least a portion of links in the connectivity model. All of these processes allow the application of a shortest path algorithm to the connectivity model (as adjusted or varied) and thereby allow new routes to be determined and thus be attempted. In other instances, e.g., when a message transmission over a route is not acknowledged, the processor is further operative to adjust link quality for one or more links corresponding to that route, thereby generating a second route for that message transmission.

Various methods have been described above, a portion of which will be summarized here. It will be appreciated that the above described apparatus and systems or other apparatus and systems with appropriate functionality/capability can be used to implement the methods. In one or more embodiments a method for providing routes and routing a message to a multiplicity of streetlight controllers was shown. The method can include or comprise: generating mesh networking routes between the multiplicity of streetlight controllers and a coordinator, at least one route reaching each of the multiplicity of streetlight controllers and a portion of the mesh networking routes comprising intermediate streetlight controllers; sending messages via the mesh networking routes with one message routed to each of the multiplicity of streetlight controllers; and receiving the one message routed to each of the multiplicity of streetlight controllers at said each of the multiplicity of streetlight controllers, wherein for the portion of mesh networking routes, the intermediate streetlight controllers forwarded the message to a subsequent streetlight controller along their, respective, mesh networking route.

In varying embodiments, the generating mesh networking routes further comprises conducting a streetlight controller discovery process including sending broadcast messages and collecting a list of neighbors from each of the multiplicity of streetlight controllers where a collective list of neighbors identifies links between the multiplicity of streetlight controllers to provide a connectivity model having links and corresponding link quality information, wherein a shortest path algorithm is used with the connectivity model for the generating mesh networking routes. In addition to or as part of generating the routes, the methods include maintaining the mesh networking routes using an ongoing learning process that includes dynamically adjusting the mesh networking routes.

The ongoing learning process can comprise updating the connectivity model with information gained during ongoing communication with at least a portion of the multiplicity of streetlight controllers and can include using exponential averaging for adjusting (increasing, decreasing, etc.) link quality information corresponding to one or more links. Maintaining the mesh networking routes in some embodiments comprises adjusting, in accordance with a health parameter for a given streetlight controller, link quality information for all links with the given streetlight controller. Additionally or alternatively, the maintaining the mesh networking routes further comprises adjusting the link quality information for all links in the connectivity model. One or more of these approaches thereby facilitate allowing new routes to be attempted, with the results used to adjust the connectivity model, etc.

Up until this point, only the communication within a subnet 520 coordinated by the local coordinator 510 has been discussed. This process will have a limit based on desired throughput, memory/processing power requirement, etc. to the number of nodes 400 that can be supported by a single local coordinator 510. The actual maximum number of nodes supported depends on the bandwidth of the physical layer, the efficiency of the higher network layers, and the communication requirements of the supported application, For a typical control network with modest bandwidth and response time requirements, the support of hundreds of nodes is possible from a single local coordinator 510.

In the event that an application requires the control of a network larger than can be supported by a single local coordinator 510, a hierarchical embodiment of the invention can be employed. In this variant of the system, the network is partitioned into a number of subnets, each with its own local coordinator 510. Each local coordinator 510 is in direct communication and under the control of a higher level centralizing device (the central coordinator 500). The mechanism for this communication could be wireless Ethernet, a data channel from a wireless telephone provider, etc., and is less constrained by cost than what is employed at the individual node 400 level.

Figure 19:
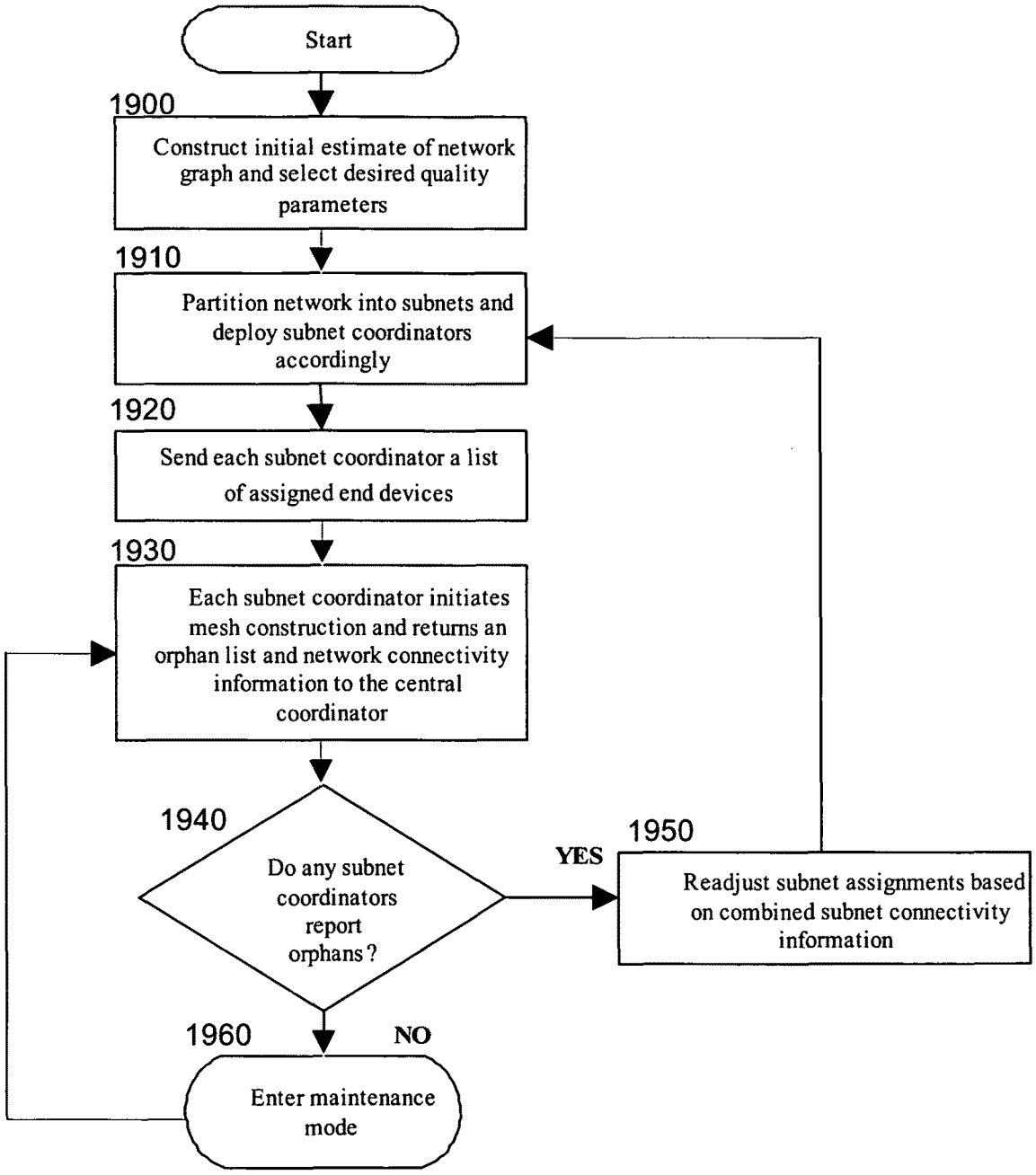
FIG. 19 depicts a flow chart of various methods of partitioning of subnets, etc. in accordance with one or more embodiments.

Referring to FIG. 19, a flow chart of various methods of partitioning of subnets, etc. in accordance with one or more embodiments will be described and discussed. The discussions below describes various methods for or associated with partitioning a large network into a number of smaller subnets 520, each with its own local coordinator 510, that are all under the organization of the central coordinator 500.

The partitioning process described herein takes place during the deployment of the network and determines locations for the local coordinators 510 and the assignment of nodes 400 to subnets 520. However, subsequent subnet 520 reassignments could continue where necessary over the lifetime of the network in order to provide an acceptable communication link to each node 400. In this embodiment, communication patterns are hierarchical and resemble a "tree" like structure, with a single root that originates from the central coordinator 500.

Figure 20:
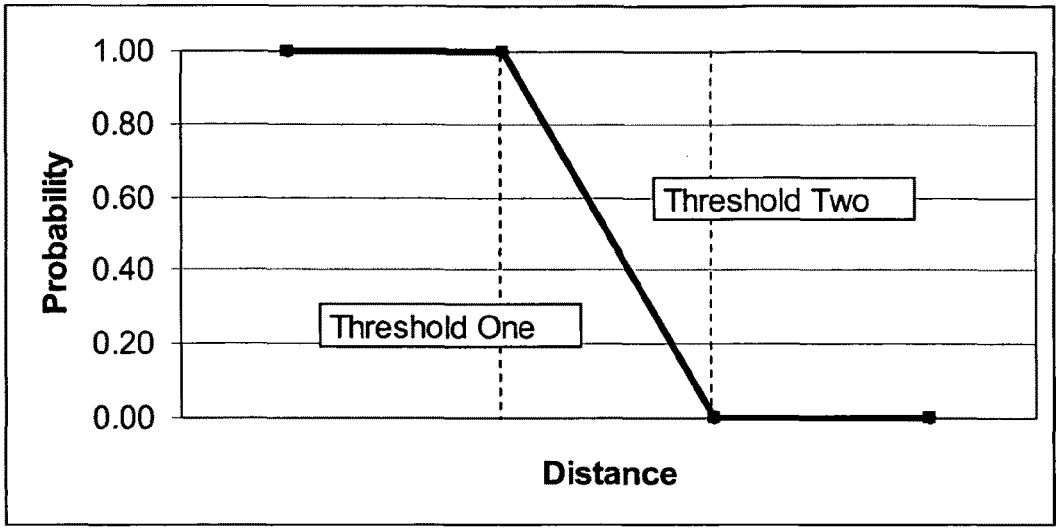
FIG. 20 illustrates one representative model of connectivity probability as a function of distance for use in conjunction with the methods of FIG. 19 in accordance with one or more embodiments.

FIG. 19 illustrates an initial partitioning process and includes the following steps or processes:

1.) Construct an initial estimate of the network graph (block 1900): Using the locations at which the nodes 400 will be deployed, construct a (possibly approximate) model of the network connectivity graph using measured or estimated inter-node link strengths. This process will rely on network engineers and technicians to provide some of the information. For example, inter-node link strengths could be estimated given a model of link strength vs. RF range and geographical information regarding node 400 locations obtained from survey data, on board GPS locators, or some other technique. For example, a simple model might assume a linear relationship between the distance separating two nodes and their probability of communicating with each other. For example, FIG. 20 illustrates one representative model of connectivity probability as a function of distance for use in conjunction with the methods of FIG. 19. As illustrated, the probability of a successful link decreases as the distance increases beyond a first threshold, etc. An alternate technique could employ an RF simulator that incorporates topography, building locations, and potential dead zones due to multi-path interference. Another technique could be to determine inter-node link strengths via empirical measurements in the field after end-device installation, but prior to finalizing the network's organization.

2.) Partition the network (block 1910): Based on the network connectivity graph, performance constraints, and possible deployment restrictions, divide the network into subnets 520 using the partitioning process described below. Then, choose an appropriate central location in each sub-net for its local coordinator 510 and deploy the local coordinator 510.

3.) Send each local coordinator 510 a list of assigned nodes (block 1920): Each local coordinator 510 receives a list of assigned nodes 400. This list may be transmitted from the central coordinator 500, manually input, etc.

4.) Build a mesh network in each subnet (block 1930): For each subnet 520, run the discovery and auto-route generation methods previously described. Pass the collected network connectivity data and list of orphans up to the central coordinator 500. An orphan node is a network component for which it appears that connectivity is of an unacceptable quality via any possible route given its current subnet 520 assignment.

5.) Adjust subnet partitioning (blocks 1940, 1950): Given the network connectivity information and orphan data gathered in step 3.), adjust the subnet 520 partitioning where possible to improve connectivity and alert higher level processes (and ultimately a human operator) of any un-resolved issues.

6.) Network Maintenance (block 1960): Continue to iterate over steps 3.) to 5.) throughout the lifetime of the network. For example when new nodes 400 are added, RF conditions change, periodically, etc., the process or portions thereof may need to be re-executed.

The partitioning process or final partitioning process takes as input a representation of the network connectivity graph (from FIG. 19), and parameters that define the minimum level of communication quality expected for each node 400 at the sub-net 520 level. The parameters defining this minimum level of communication can be referred to as quality parameters. For example, consider a simplified network model in which inter-node link strengths can only be assigned the value of zero or one, then the maximum acceptable number of hops to the local coordinator 510 could be used as a (sufficient) quality parameter; i.e. the minimum level of communication quality for each node 400 is that it is no more than k hops to its local coordinator 510. On the other hand, in a probabilistic representation of inter-node link strength, the quality parameters could consist both of a minimum overall acceptable transmission probability, and a maximum path length in terms of hops. For example, if the optimal route between a node 400 and its nearest local coordinator 510 required two hops, each over a link with a transmission probability of 90 per cent, then the overall transmission probability for this route would be 81 per cent. If this value was less than the quality parameters specifying the minimum overall transmission probability or the maximum allowable hops then this route would be considered to have an un-acceptable level of communications. Another quality parameter might specify that a node 400 is not required to share its local coordinator 510 with more than some specified maximum of other nodes 400; i.e. the size of each subnet 520 can be bounded.

Given a representation of the network connectivity graph, and the parameters that define the minimum level of communication quality, a process of partitioning the nodes 400 into a number of subnets 520 each with its own local coordinator 510 such that all nodes 400 have a quality of communication over the specified minimum may be implemented. Any suitable partitioning scheme may be used.

Figure 21:
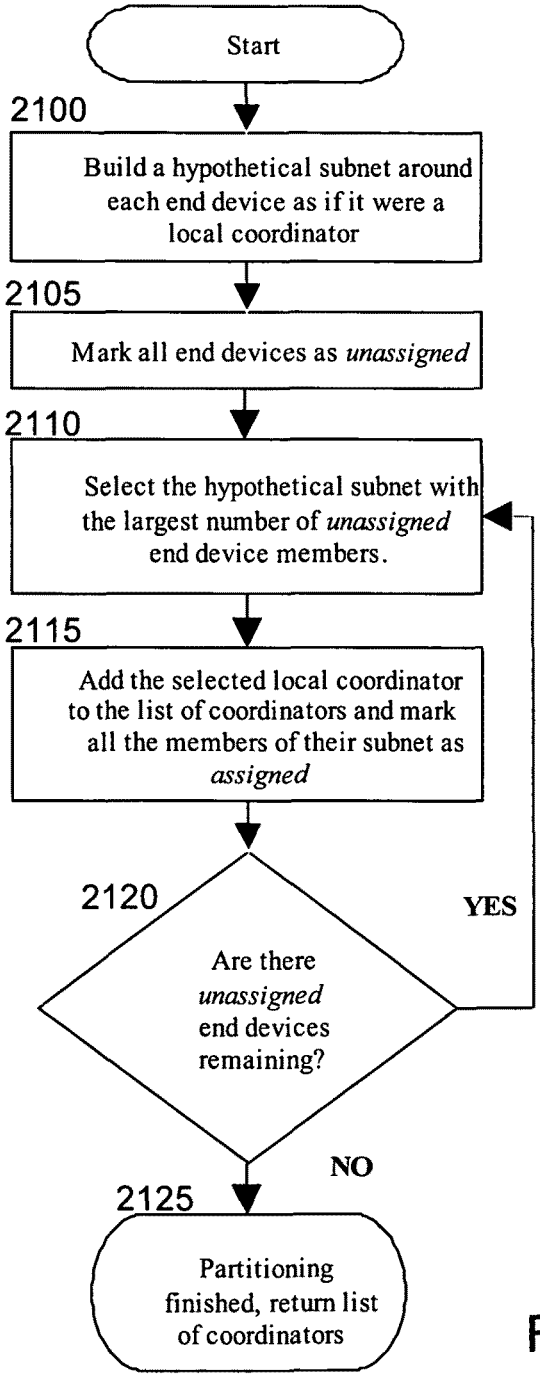
FIG. 21 shows a flow chart illustrating representative embodiments of methods of final partitioning into subnets with associated local coordinators in accordance with one or more embodiments.

Referring to FIG. 21, a flow chart illustrating representative embodiments of methods of final partitioning into subnets with associated local coordinators in accordance with one or more embodiments. FIG. 21 illustrates one example for partitioning a network into subnets and includes the following processes.

1.) Build a hypothetical subnet around each node 400 as if it were a local coordinator 510 (block 2100): Given the provided network connectivity model, this step consists of applying shortest path graph algorithms in order to determine which nodes 400 could be reached with an acceptable quality of communication if the node 400 in question had a local coordinator 510 placed in close proximity, such that its communication potential could be considered roughly equivalent to that of the node 400. For example consider a case where the network connectivity model only differentiated between link qualities of one or zero and the quality parameters specified that acceptable communications occur only over routes of less than two hops. Then the hypothetical subnet 520 built around each of the nodes 400 would consist of that node's neighbors, and the neighbors of each of its neighbors. Note that a graphical network model where the edge weights are proportional to some communication cost metric is also possible with this scheme. In this case, the quality parameters might specify that only routes with a communication cost below some specified cost threshold are acceptable.

The outcome of this step is a list of hypothetical subnets, and the end-devices that could be assigned to each subnet with an acceptable level of communication performance. Note that, at this point each node is likely a member of many hypothetical subnets. The location of each node as a potential location for a coordinator. However, at the end of the process its is likely that only a small number of coordinators will actually be placed.

2.) Initialize data structures (block 2105): Initialize an array that maintains the status of each node 400. The status of each node 400 is initialized to un-assigned.

3.) Build a coordinator List (blocks 2110, 2115): Select the hypothetical subnet which currently contains the largest number of un-assigned nodes 400. Add the hypothetical coordinator of this subnet 520 to a list of local coordinators 510 and mark all of its nodes 400 assigned. Remove this subnet 520 from the list of hypothetical subnets.

4.) Iterate until Done (block 2120): Iterate over step 3.) until each node 400 in the network is marked assigned. At the end of this process, the list of nodes 400 chosen as potential local coordinator 510 locations should provide complete coverage. Local coordinators 510 could actually be deployed near these locations, or the appropriate nodes 400 could be promoted to local coordinator 510 status if they have that ability.

5.) Assignment of end-devices (block 2125): Now assign each node 400 to the local coordinator 510 that can provide the highest level of service in terms of communication quality. For this step, we consider the communication quality between each node 400 and each of the local coordinators 510 given the network connectivity model and shortest path graph algorithms. The node 400 is then assigned to the local coordinator 510 with which it has the best communication quality. If the quality is roughly equal between two local coordinators 510, then assign the node 400 to the local coordinator 510 with the smaller number of nodes 400 in their subnet 520.

A mechanism for multi-hop mesh communications suitable for large control or data collection networks in which a centralized structure is appropriate has been presented. The approach is specialized for this class of control-style applications and may not provide the full suite of functionality typically supported at the network layer. Therefore, a centralized and hierarchical organization which provides a high level of scalability and performance and does not require considerable intelligence in each network component endowed with routing capabilities is exploited. The technique provides an alternative to currently available solutions which provide more general routing functionality at the possible expense of scalability and greater system complexity.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A system for monitoring and controlling streetlights, the system comprising:

a multiplicity of streetlight controllers with each streetlight controller comprising;

at least one switch operative to control the operation of a load, at least one sensor operative to monitor the operation of said load, at least one processor coupled to said switch and said sensor, and a radio transceiver coupled to said processor and operative to receive data representing a control action associated with said each streetlight controller and transmit data associated with said each streetlight controller in respect to said at least one sensor, and a local coordinator comprising;

a local coordinator radio transceiver, and a local coordinator processor coupled to the coordinator radio transceiver, the local coordinator processor operative to maintain a list of the multiplicity of streetlight controllers and, cooperatively with the local coordinator radio transceiver, operative to exchange messages with any of the multiplicity of streetlight controllers and a central coordinator for facilitating monitoring and controlling of the multiplicity of streetlights;

wherein each of the multiplicity of streetlight controllers is configured to:

receive a first broadcast message comprising an address associated with a transmitter that transmitted the first broadcast message, and in response to the first broadcast message transmit a second broadcast message containing an address of the streetlight controller, record the address associated with the transmitter into a list of addresses when the first broadcast message is received and the address associated with the transmitter is not in the list of addresses, and in cooperation with the radio transceiver, transmit the list of addresses to the local coordinator;

wherein the local coordinator processor is further operative to:

maintain a connectivity model for the list of the multiplicity of streetlight controllers, the connectivity model comprising, for each of the multiplicity of streetlight controllers, a list of addresses of neighbors and, respective, link quality information;

adjust the connectivity model to reflect a health parameter for said each of the multiplicity of streetlight controllers, the health parameter used to vary the link quality information for links associated with a corresponding streetlight controller;

generate routes from the local coordinator to said each of the multiplicity of streetlight controllers based on the connectivity model; and transmit monitoring and control messages between the central coordinator and the multiplicity of streetlights based upon the generated routes.

2. The system of claim 1 wherein the local coordinator processor is further operative to adjust the connectivity model based on a history of message transmission via one or more of said each of the multiplicity of streetlight controllers.

3. The system of claim 2 wherein the local coordinator processor is further operative to use exponential averaging to adjust the connectivity model.

4. The system of claim 1 wherein the local coordinator processor is further operative to adjust the, respective, link quality information for all links in the connectivity model, thereby allowing new routes to be attempted.

5. The system of claim 1 wherein the local coordinator processor is further operative to generate a set of routes from the local coordinator to the multiplicity of streetlight controllers with at least one route touching each of the multiplicity of streetlight controllers.

6. The system of claim 5 wherein a portion of the routes in the set of routes include two or more of the multiplicity of streetlight controllers and the local coordinator processor is further operative to indicate in a message for transmission over a route of the portion of routes, which of the two or more of the multiplicity of streetlight controllers should process a payload in the message.

7. The system of claim 1 wherein the health parameter is adjusted based upon a history of message transmission via one or more of said each of the multiplicity of streetlight controllers wherein successful communication to the corresponding streetlight controller by the local controller increases the health parameter and failure to communicate with the corresponding streetlight controller decreases the health parameter.

8. The system of claim 7 wherein the quality parameter is defined by a maximum number of hops to the local coordinator from the corresponding streetlight controller.

9. The system of claim 7 wherein the quality parameter is defined by both of a minimum overall acceptable transmission probability, and a maximum path length in terms of hops from the corresponding streetlight controller.

10. The system of claim 1 wherein the connectivity model is further adjusted based on a quality parameter defining a minimum level of communication quality expected for each streetlight controller.

11. A local coordinator for a multiplicity of streetlight controllers, which provides routes to the multiplicity of streetlight controllers, the local coordinator comprising:

a radio transceiver; and a processor coupled to the radio transceiver and operative, to maintain a list of the multiplicity of streetlight controllers, each streetlight controller having a sensor to monitor the operation of a respective load of the streetlight;

to generate a route from the coordinator to each of the multiplicity of streetlight controllers, cooperatively with the radio transceiver, to send messages to and receive messages from any of the multiplicity of streetlight controllers, comprising:

to send a first broadcast message with the address of the coordinator, for instructing the streetlight controller to record addresses associated with neighbor streetlight controllers, and to send an addressed message to each streetlight controller for collecting the recorded addresses from the streetlight controller;

to maintain a connectivity model for the list of the multiplicity of streetlight controllers, the connectivity model comprising, for each of the multiplicity of streetlight controllers, a list of addresses of neighbors and, respective, link quality information;

to adjust the connectivity model to reflect a health parameter for said each of the multiplicity of streetlight controllers, the health parameter used to vary the link quality information for links associated with a corresponding streetlight controller;

to generate a route from the coordinator to each of the multiplicity of streetlight controllers based on the connectivity model; and to send and receive messages with a central coordinator for facilitating monitoring and controlling of the multiplicity of streetlights.

12. The coordinator of claim 11 wherein the processor cooperatively with the radio transceiver conducts a streetlight controller discovery process pursuant to maintaining the connectivity model, the discovery process further comprising:

transmitting the first broadcast message including an address for the local coordinator;

responsive to the transmitting, receiving second broadcast messages, each of the second broadcast messages including an address for a, respective, streetlight controller that transmitted said each of the second broadcast messages, saving each unique address in the second broadcast messages;

transmitting the addressed message to said each unique address, the addressed message requesting a list of neighbor addresses from each streetlight controller associated with said each unique address;

receiving the list of neighbor addresses from said each streetlight controller and identifying new addresses; and transmitting additional addressed messages to each, respective, new address, receiving a corresponding list of neighbors, and identifying, corresponding new addresses until there are no new addresses.

13. The coordinator of claim 11 wherein the processor is further operative to adjust the connectivity model based on a history of message transmission via one or more of said each of the multiplicity of streetlight controllers.

14. The coordinator of claim 11 wherein the processor is further operative to use exponential averaging to adjust the connectivity model.

15. The coordinator of claim 11 wherein the processor is further operative to adjust the, respective, link quality information for at least a portion of links in the connectivity model, thereby allowing new routes to be attempted.

16. The coordinator of claim 11 wherein, when a message transmission over a route is not acknowledged, the processor is further operative to adjust link quality for one or more links corresponding to that route, thereby generating a second route for that message transmission.

17. The local coordinator of claim 11 wherein the health parameter is adjusted based upon a history of message transmission via one or more of said each of the multiplicity of streetlight controllers wherein successful communication to the corresponding streetlight controller by the local controller increases the health parameter and failure to communicate with the corresponding streetlight controller decreases the health parameter.

18. The local coordinator of claim 11 wherein the connectivity model is further adjusted based on a quality parameter defining a minimum level of communication quality expected for each streetlight controller.

19. The local coordinator of claim 18 wherein the quality parameter is defined by a maximum number of hops to the local coordinator from the corresponding streetlight controller.

20. The local coordinator of claim 18 wherein the quality parameter is defined by both of a minimum overall acceptable transmission probability, and a maximum path length in terms of hops from the corresponding streetlight controller.

* * * * *

UNITED STATES PATENT AND TRADEMARK OFFICE

CERTIFICATE OF CORRECTION

PATENT NO. : 8,570,190 B2
APPLICATION NO. : 12/231929
DATED : October 29, 2013
INVENTOR(S) : Dimitri Marinakis et al.

It is certified that error appears in the above-identified patent and that said Letters Patent is hereby corrected as shown below:

In the Specification:

Col. 6, line 21, "these concepts alt relate to" should read --these concepts all relate to--;

Col. 12, line 51, "set CurrentNode to NextNode and go to Step 4 (block 1330)" should read --set CurrentNode to NextNode and go to Step 4 (block 1330).--;

Col. 13, line 29, "success of 80 per cent" should read --success of 80 percent--;

Col. 16, line 25, "to place on recently obtained measurements" should read --to place on recently obtained measurements.--;

Col. 20, line 48, "of the supported application, For a typical" should read --of the supported application. For a typical--;

Col. 20, lines 66-67, "The discussions below describes various methods" should read --The discussion below describes various methods--;

Col. 22, line 20, "probability of 90 per cent" should read --probability of 90 percent--;

Col. 22, lines 21-22, "route would be 81 per cent." should read --route would be 81 percent.--.

Signed and Sealed this
Twenty-eighth Day of January, 2014

Michelle K. Lee

Michelle K. Lee
*Deputy Director of the United States Patent and Trademark Office*